US008548369B2

(12) United States Patent
Kim

(10) Patent No.: US 8,548,369 B2
(45) Date of Patent: Oct. 1, 2013

(54) IMAGE FORMING APPARATUS REDUCING DRIVING NOISE

(75) Inventor: Hyun-ho Kim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 945 days.

(21) Appl. No.: 12/555,041

(22) Filed: Sep. 8, 2009

(65) Prior Publication Data

US 2010/0061763 A1 Mar. 11, 2010

(30) Foreign Application Priority Data

Sep. 8, 2008 (KR) ..... 10-2008-0088462
Nov. 20, 2008 (KR) ..... 10-2008-0115859

(51) Int. Cl.
*G03G 15/00* (2006.01)

(52) U.S. Cl.
USPC ..... 399/393; 399/391

(58) Field of Classification Search
USPC ..... 399/393
See application file for complete search history.

(56) References Cited

U.S. PATENT DOCUMENTS 5,882,002 A * 3/1999 Kamei et al. ..... 271/118
6,246,466 B1 * 6/2001 Hirano et al. ..... 355/407
6,361,038 B1 * 3/2002 Tada et al. ..... 271/111
7,156,389 B2 * 1/2007 Kadowaki et al. ..... 271/118
7,450,886 B2 * 11/2008 Ahn et al. ..... 399/167
7,587,166 B2 * 9/2009 Aono ..... 399/401
7,648,134 B2 * 1/2010 Lim ..... 271/118
7,784,928 B2 * 8/2010 Okamoto ..... 347/101
7,959,147 B2 * 6/2011 Izuchi et al. ..... 271/9.02

FOREIGN PATENT DOCUMENTS

JP 06-250475 9/1994
KR 100188853 1/1999
KR 20050091847 9/2005

* cited by examiner

*Primary Examiner* — Anthony Nguyen
(74) *Attorney, Agent, or Firm* — Stanzione & Kim, LLP

(57) ABSTRACT

An image forming apparatus which includes a main body, an image forming unit to form an image on a printing medium, a plate to open and close a first side of the main body; a pickup unit which includes a driven gear to rotate in forward and backward directions, a pickup roller to receive a driving force from the driven gear to pick up the printing medium disposed on the plate, and a support frame to rotatably support the pickup roller and to interlock with the forward and backward rotations of the driven gear to move toward and away from the plate, a driving source to drive the image forming unit and the driven gear, and a blocking gear disposed between the driven gear and the driving source, to prevent the support frame, spaced apart from the plate, from moving toward the plate.

22 Claims, 23 Drawing Sheets

IMAGE FORMING APPARATUS REDUCING DRIVING NOISE

CROSS-REFERENCE TO RELATED APPLICATIONS

This application claims priority under 35 U.S.C. §119(a) from Korean Patent Applications No. 10-2008-0088462, filed on Sep. 8, 2008, and No. 10-2008-0115859, filed on Nov. 20, 2008, in the Korean Intellectual Property Office, the disclosures of which are incorporated herein in their entirety by reference.

BACKGROUND

1. Field of the Invention

The present general inventive concept relates to an image forming apparatus, and more particularly, to an image forming apparatus capable of reducing a driving noise in a manual process of supplying a printing medium.

2. Description of the Related Art

An image forming apparatus includes an image forming unit to form an image on a printing medium, and a printing medium supplying cassette detachably coupled to a main body of the image forming apparatus for supplying the printing medium to the image forming unit. Also, in addition to the printing medium supplying type by the printing medium supplying cassette, the image forming apparatus employs a manual printing medium supplying type, that is, supplying a printing medium to the image forming unit by opening a cover capable of opening and closing a side of the main body and disposing the printing medium onto the cover.

Here, the cover includes a plate on which the printing medium is disposed, and a pickup roller is disposed onto the main body of the image forming apparatus to pick up the printing medium disposed on the plate, when the cover is opened. The plate is elastically biased to be bumped against the pickup roller.

However, if there is no printing command, a cam distances the elastically biased plate away from the pickup roller, and if there is a printing command, the plate is bumped against the pickup roller as the cam rotates. A pickup performance increases as the pickup roller and the plate are forced to contact each other, and therefore the force which biases the pickup roller toward the plate is relatively strong.

However, a driving noise increases as the plate is bumped against the pickup roller.

SUMMARY

Exemplary embodiments of the present general inventive concept provide an image forming apparatus capable of reducing a driving noise in a manual printing medium supplying.

Exemplary embodiments of the present general inventive concept provide an image forming apparatus capable of reducing costs associated therewith.

Exemplary embodiments of the present general inventive concept provide an image forming apparatus capable of making a product having a small size.

Additional features and/or utilities of the present general inventive concept will be set forth in part in the description which follows and, in part, will be obvious from the description, or may be learned by practice of the general inventive concept Exemplary embodiments of the present general inventive concept provide an image forming apparatus which includes a main body, the image forming apparatus including an image forming unit to form an image on a printing medium, a plate to open and close a first side of the main body; a pickup unit which includes a driven gear to rotate in forward and backward directions, a pickup roller to receive a driving force from the driven gear to pick up the printing medium disposed on the plate, and a support frame to rotatably support the pickup roller and to interlock with the forward and backward rotations of the driven gear to move toward and away from the plate, a driving source to drive the image forming unit and the driven gear; and a blocking gear disposed between the driven gear and the driving source to prevent the support frame spaced apart from the plate from moving toward the plate.

The image forming apparatus may include a sensor which senses whether there is the printing medium on the plate or not; and a control unit which controls the driving source to rotate the driven gear in a forward direction so that the support frame may approach the plate and the pickup roller may pick up the printing medium.

The image forming apparatus may include a pickup clutch which is disposed between the blocking gear and the driving source, and intermittently transmits a driving force of the driving source to the driven gear.

The control unit may control the pickup clutch so that the driving force of the driving source can be prevented from being transmitted to the driven gear if the printing medium on the plate is completely picked up.

The control unit may control the driving source to rotate the driven gear in a backward direction so that the support frame can be distanced from the plate if there is no printing medium on the plate.

The driving source may include a single driving motor.

The image forming unit may include a developing cartridge which accommodates an image carrying body on which an electrostatic latent image is formed and a developing roller to develop the image carrying body by a developer, and is detachably mounted to the main body; a transferring unit which is disposed to face the image carrying body, and transfers the developed developer to the printing medium; and a fusing unit which fuses the transferred developer on the printing medium.

The image forming apparatus may include a developing unit clutch which selectively transmits a driving force of the driving source to the developing cartridge and the transferring unit so that the developing cartridge and the transferring unit can rotate in one direction; and a fusing unit clutch which selectively transmits a driving force of the driving source to the fusing unit so that the fusing unit can rotate in one direction.

The image forming apparatus may include an engagement unit which is provided to one of the support frame and the main body of the image forming apparatus; and an engagement threshold which is provided to the other of the support frame and the main body to be engaged with the engagement unit when the pickup unit moves to be spaced apart from the plate.

The engagement threshold may rotate between a first position engaged with the engagement unit, and a second position released from the engagement unit, and the image forming apparatus may includes an elastic member which elastically biases the engagement threshold toward the first position.

The engagement unit may include an inclined surface which rotates the engagement threshold to the second position when contacting the engagement threshold.

The image forming apparatus may include a control unit which controls the driving source to rotate the driven gear in the forward direction so that the engagement unit can be released from the engagement threshold.

A rotation moment by an elastic force of the elastic member may be larger than a rotation moment by a weight of the pickup unit, and may be less than a rotation moment generated by the forward direction of the driven gear.

The image forming apparatus may include a cover which opens and closes a side of the main body and the pickup unit may be disposed on the cover to rotate together with the cover.

The plate may be rotatably disposed to the cover.

The image forming apparatus may include a pickup unit driving force regulating unit which is disposed between the blocking gear and the driving source, and intermittently transmits a driving force of the driving source to the pickup unit.

The pickup unit driving force regulating unit may include a ring gear which receives the driving force of the driving source to rotate in forward and backward directions; a sun gear which is disposed to face the ring gear; and a support gear which is interposed between the ring gear and the sun gear, includes a ring gear boss extending in a first side along a rotation central axis of the support gear to support the ring gear and a sun gear boss extending in a second side along the rotation central axis to support the sun gear, and transmits the driving force to the driven gear of the pickup unit.

The image forming apparatus may include a pair of planetary gears which are disposed to be spaced apart from each other inside the support gear, and the sun gear may include a protruding unit inserted to the sun gear boss, and an outer surface of the protruding unit is formed with a sun gear teeth engaged with the planetary gears when being inserted to the sun gear boss.

The ring gear may include an inner teeth formed to an inner surface of the ring gear to be engaged with the planetary gears when being inserted to the ring gear boss.

The image forming apparatus may include a lever movable to allow and prevent a free rotation of the sun gear; and a lever driving unit to drive the lever.

The image forming apparatus may include a control unit which controls the lever driving unit so that the lever can prevent the free rotation of the sun gear.

The image forming apparatus may include a control unit which controls the lever driving unit so that the lever can allow the free rotation of the sun gear if it is unnecessary to pick up the printing medium.

Exemplary embodiments of the present general inventive concept are also achieved by providing a printing medium pickup apparatus usable with an image forming apparatus, the print medium pickup apparatus including a pickup unit which comprises a driven gear to rotate in forward and backward directions, a pickup roller to receive a driving force from the driven gear to pick up a printing medium disposed on a plate of the image forming apparatus, and a support frame to rotatably support the pickup roller and to interlock with the forward and backward rotations of the driven gear to move toward and away from the plate, a driving source to drive the image forming apparatus and the driven gear, and a blocking gear disposed between the driven gear and the driving source to prevent the support frame spaced apart from the plate from moving toward the plate.

Exemplary embodiments of the present general inventive concept are also achieved by providing a printing medium pickup apparatus which includes a driving unit rotatable in first and second directions, a first gear unit corresponding to a print medium pickup unit and coupled to the driving unit, a second gear unit corresponding to a developing unit and coupled to the driving unit, and a third gear unit corresponding to a discharge unit and coupled to the driving unit, wherein the driving unit rotates in the first direction so that the first gear unit drives the print medium pickup unit to pick up the print medium, the second gear unit drives the second gear unit to develop the print medium, and the third gear unit drives the discharge unit to discharge the developed print medium.

The second and third gear units may be in an idle state when the driving unit rotates in the second direction.

Exemplary embodiments of the present general inventive concept are also achieved by providing an image forming apparatus having a printing medium pickup apparatus, the image forming apparatus including a driving unit rotatable in first and second directions, a first gear unit corresponding to a print medium pickup unit and coupled to the driving unit, a second gear unit corresponding to a developing unit and coupled to the driving unit, and a third gear unit corresponding to a discharge unit and coupled to the driving unit, wherein the driving unit rotates in the first direction so that the first gear unit drives the print medium pickup unit to pick up the print medium, the second gear unit drives the developing unit to develop the print medium, and the third gear unit drives the discharging unit to discharge the developed print medium, and wherein at least one of the first, second, and third gear units is configured to apply an opposite force to a driving force of the driving unit to reduce noise.

The second and third gear units may be in an idle state when the driving unit rotates in the second direction.

Exemplary embodiments of the present general inventive concept are also achieved by providing a printing medium pickup apparatus which includes a driving unit rotatable in first and second directions, a print medium pickup gear unit having at least one gear, and a gear unit to drive the print medium pickup gear unit and to apply an opposite force to at least one of the gears to reduce a noise of the print medium pickup unit.

BRIEF DESCRIPTION OF THE DRAWINGS

The present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
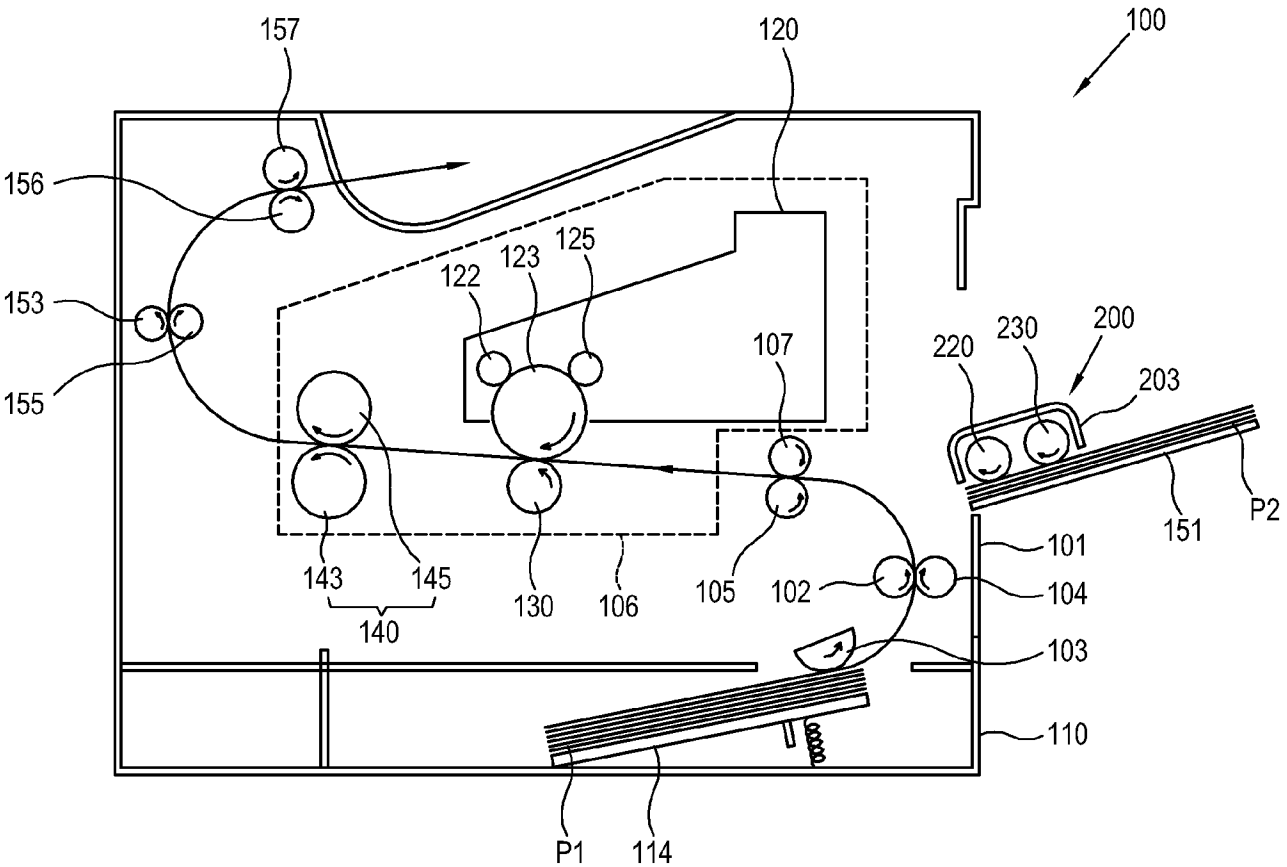
FIG. 1 is a schematic sectional view of an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for the convenience of clarity.

Figure 2:
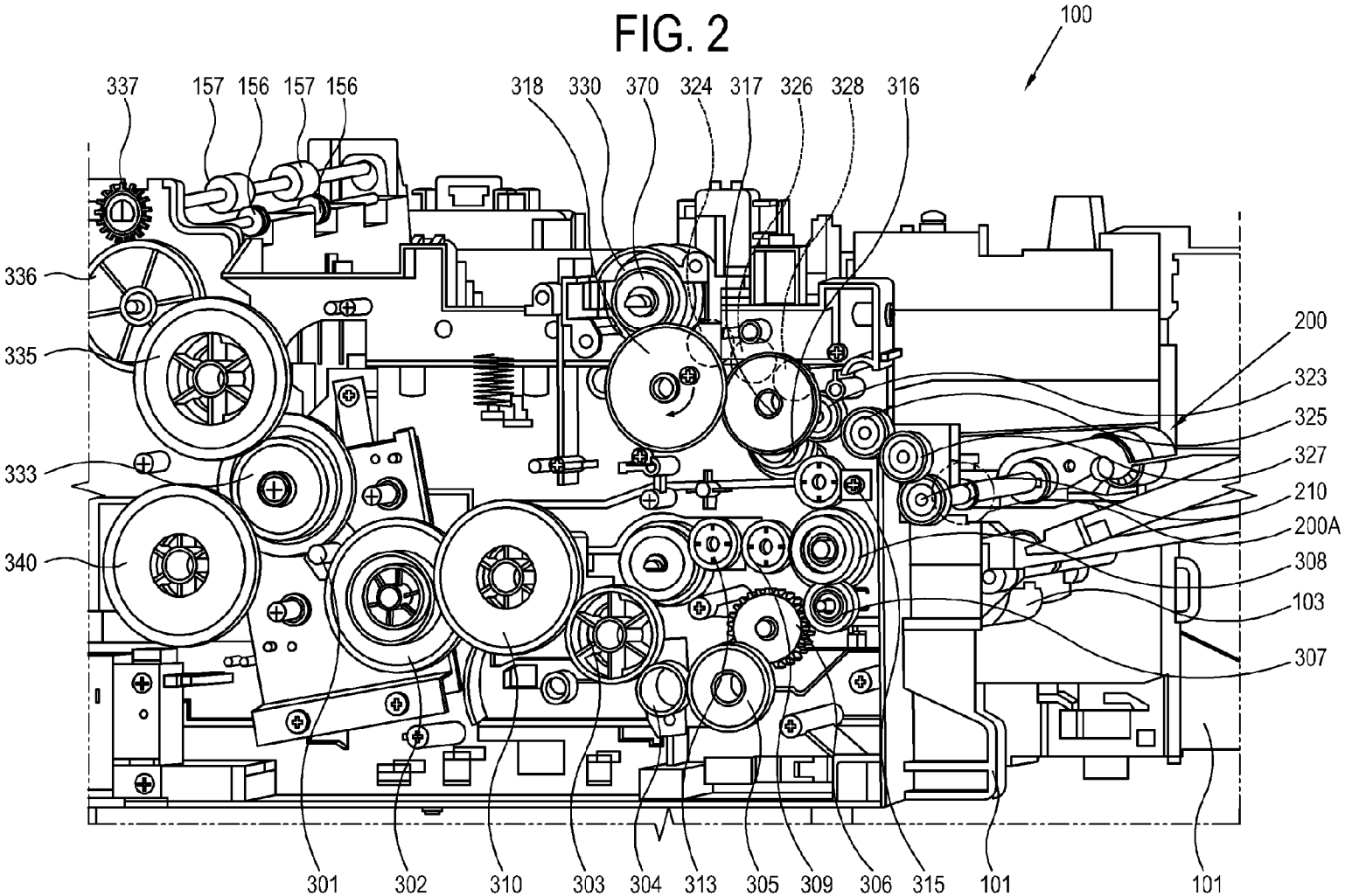
FIG. 2 is a side perspective view of the image forming apparatus in FIG. 1.
Figure 6:
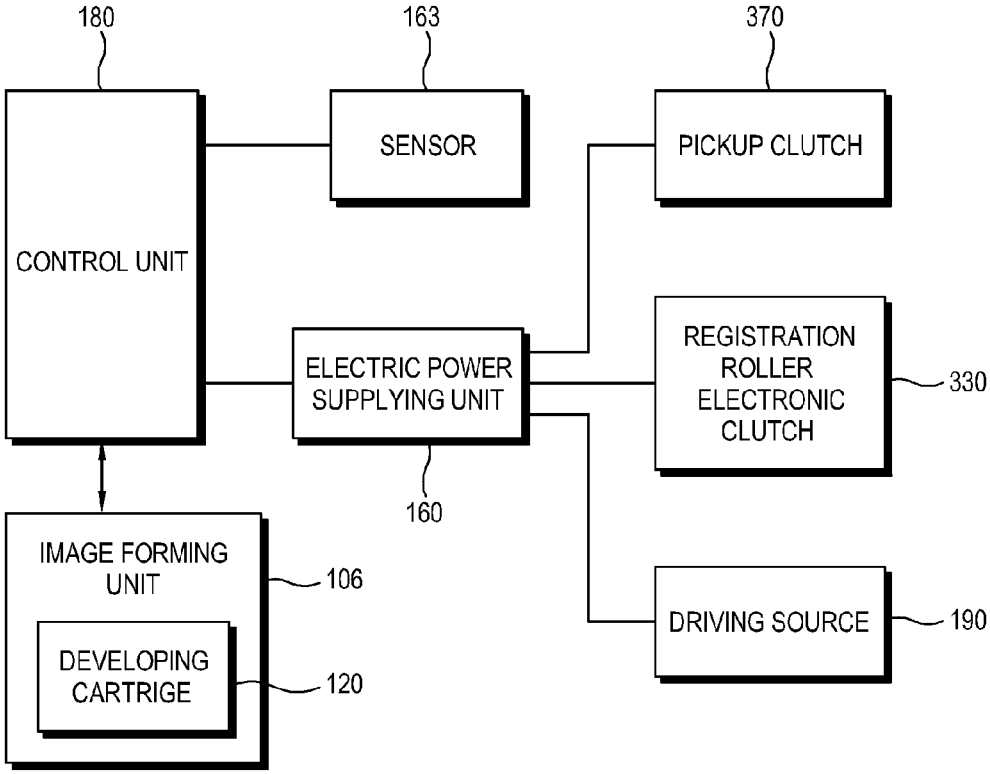
FIG. 6 is a schematic block diagram of the image forming apparatus in FIG. 1.

As illustrated in FIGS. 1 and 2, an image forming apparatus 100 according to an exemplary embodiment of the present general inventive concept includes a main body 101, a printing medium supplying cassette 110 detachably coupled to the main body 101, an image forming unit 106 to form an image on a printing medium, a plate 151 to open and close a side of the main body 101, wherein a printing medium is loaded in the opening, a pickup unit 200, a driving source 190 in FIG. 6 to drive the image forming unit 106 and the pickup unit 200, and a blocking gear 327 to block or prevent the pickup unit 200, spaced apart from the plate 151, from moving toward the plate 151. Here, a portion at which the plate 151 and the pickup unit 200 are disposed in the image forming apparatus 100 is referred to as a multi purpose tray. A user opens the plate 151 and puts a printing medium on the plate 151 to be supplied inside of the image forming apparatus 100 when he wishes to use the multi purpose tray rather than the printing medium supplying cassette 110.

A rotation direction of each roller 102, 103, 104, 105, 107, 122, 123, 125, 130, 133, 135, 143, 145, 147, and 149 illustrated in FIG. 1 corresponds to a state in which a driving pinion 301 in FIG. 2 rotates in a first direction, such as a forward direction (A).

In exemplary embodiments, one printing medium P1 of the printing medium supplying cassette 110 and a printing medium P2 of the plate 151 may be supplied to the image forming unit 106 to be printed on by the image forming unit 106. In an exemplary embodiment, the printing medium P2 of the plate 151 is supplied to the image forming unit 106, and the printing medium P1 of the printing medium supplying cassette 110 may be supplied if there is no printing medium P2 disposed on the plate 151. In the present exemplary embodiment, a sensor 163 in FIGS. 6 through 8 which is used to sense an existence of the printing medium P2 on the plate 151 may be disposed on the main body 101.

In exemplary embodiment, the printing medium P1 loaded on a knock-up plate 114 of the printing medium supplying cassette 110 may be picked up by a cassette pickup roller 103, and may be transported to a registration roller 105 via transporting rollers 102 and 104. Also, the printing medium P2 loaded on the plate 151 may be transported to the registration roller 105 by the pickup unit 200.

The registration roller 105 aligns leading ends of the transported printing mediums P1 and P2, and then transports the printing mediums P1 and P2 to the image forming unit 106.

In exemplary embodiments, the image forming unit 106 may include an exposing unit (not illustrated), a developing cartridge 120, a transferring unit 130 facing an image carrying body 123, and a fusing unit 140.

In exemplary embodiments, the developing cartridge 120 accommodates the image carrying body 123, a charging roller 122 and a developing roller 125, and may store a developer. The charging roller 122 charges a surface of the image carrying body 123, and the charged surface of the image carrying body 123 is exposed by the exposing unit so that an electrostatic latent image corresponding to a desired image may be formed onto the surface of the image carrying body 123. The developing roller 125 develops the electrostatic latent image by using the developer stored in the developing cartridge 120, and the transferring unit 130 transfers the developed developer on the surface of the image carrying body 123 onto the printing medium P1 or P2 by an electric attraction.

The fusing unit 140 includes a heating roller 145 and a pressing roller 143, and applies heat and/or pressure to the developer transferred to the printing medium P1 or P2 in order to fuse the developer onto the printing medium P1 or P2.

The printing of the printing medium P1 or P2 is completed after passing through the fusing unit 140 and is then discharged by discharging rollers 153, 155, 156, 157, and 159.

FIG. 2 illustrates a process in which a driving force is transmitted to each element of the image forming apparatus 100. The image forming apparatus 100 may employ a single driving motor, which is employed as the driving source 190 in FIG. 6.

In an exemplary embodiment, all of the processes from picking up a printing medium from the printing medium supplying cassette 110 or from the plate 151 to discharging the printing medium after being printed on are to be performed when the driving pinion 301, which is connected to a driving shaft of the driving motor (i.e., a driving unit) (not illustrated) rotates in a forward direction.

In exemplary embodiments, the cassette pickup roller 103 may be coaxially connected to a cassette pickup roller gear 306. The cassette pickup roller gear 306 receives a driving force from the driving pinion 301 by a gear 302 engaged with the driving pinion 301, a developing unit driving gear 310, and three gears 303, 304, and 305.

The transporting roller 102 may be coaxially connected to the transporting roller gear 307. A driving force transmission from the driving pinion 301 to the transporting roller gear 307 may be performed in an order of the driving pinion 301, the gear 302, the developing unit driving gear 310, the gear 303, a registration roller electronic clutch 330, gears 313, 309 and 308, and then the transporting roller gear 307. However, the present general inventive concept is not limited thereto. That is, in alternative exemplary embodiments, the driving force transmission may be performed in various other orders, as required.

The registration roller 105 may be coaxially connected with the registration roller electronic clutch 330. In exemplary embodiments, the driving force transmission up to the registration roller electronic clutch 330 is as described above.

In further exemplary embodiments, the registration roller electronic clutch 330 may transmit a driving force of the driving pinion 301 to the registration roller 105 when an electric power is supplied from an electric power supplying unit 160 of FIG. 6 (in case of being turned on), and does not transmit the driving force of the driving pinion 301 to the registration roller 105 when the electric power is not supplied (in case of being turned off). The driving force transmission to the registration roller 105 may be broken in order to make the registration roller 105 have a stationary state so that a leading end of a printing medium P1 or P2 transported by the transporting rollers 102 and 104 or the pickup unit 200 may be bumped against the registration roller 105, to thereby align the printing medium P1 or P2.

The driving force transmission to the developing cartridge 120 and the transferring unit 130 may be performed through the developing unit driving gear 310. That is, in exemplary embodiments, the developing unit driving gear 310 may receive a driving force via the gear 302 from the driving pinion 301.

Figure 5:
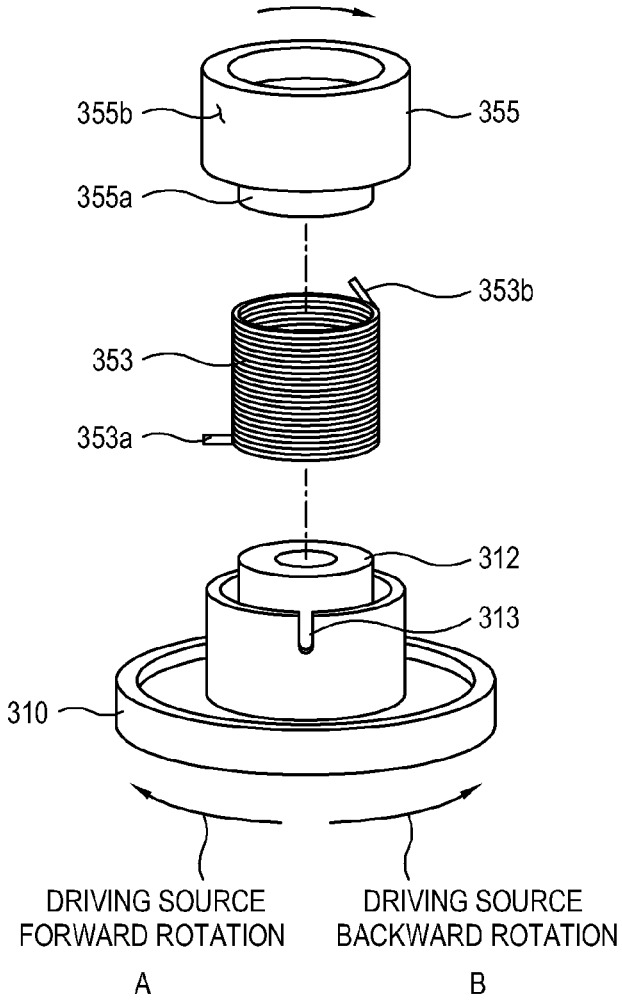
FIG. 5 is an exploded schematic perspective view of a developing unit clutch of the image forming apparatus in FIG. 1.

As illustrated in FIG. 5, a developing unit clutch 353 may be disposed between the developing unit driving gear 310 and a distributing gear 355.

The developing unit driving gear 310 includes a boss 312 which protrudes toward the distributing gear 355, and the distributing gear 355 includes a boss 355*a* which protrudes toward the developing unit driving gear 310. The developing cartridge 120 and the transferring unit 130 may be engaged to the distributing gear 355 through a gear (not illustrated).

In an exemplary embodiment, the developing unit clutch 353 may be provided as a spring clutch surrounding outer surfaces of the bosses 312 and 355*a* of the developing unit driving gear 310 and the distributing gear 355. However, the present general inventive concept is not limited thereto.

As the driving pinion 301 rotates in the forward direction (A), the developing unit driving gear 310 also rotates in the forward direction A. In this case, the developing unit clutch 353 concurrently presses against the outer surfaces of the bosses 312 and 355*a* of the developing unit driving gear 310 and the distributing gear 355 so that the driving force may be transmitted from the developing unit driving gear 310 to the distributing gear 355. However, if the driving pinion 301 rotates in a backward direction B, the developing unit driving gear 310 may also rotate in the backward direction B, and the developing unit clutch 353 idles from the outer surfaces of the boss 355*a* of the distributing gear 355 to thereby prevent the driving force of the developing unit driving gear 310 from being transmitted to the distributing gear 355.

Accordingly, in exemplary embodiments, only when the driving pinion 301 rotates in the forward direction A, does the image carrying body 123, the discharging roller 122 and the developing roller 125 in the developing cartridge 120 and the transferring unit 130 rotate in directions as illustrated in FIG. 1. In an exemplary embodiment, when the driving pinion 301 rotates in the backward direction B, the image carrying body 123, the discharging roller 122, and the developing roller 125 maintain stationary states. Accordingly, the developing unit clutch 353 may apply an opposite force to the developing unit driving gear 310 rotating in a rotational direction of the developing unit driving gear 310.

The spring clutch is an exemplary embodiment of the developing unit clutch 353. However, the present general inventive concept is not limited thereto. That is, in alternative exemplary embodiments, various other known clutches such as an electronic clutch, a hub clutch, etc. may be employed.

Referring now back to FIGS. 1 and 2, in exemplary embodiments, the fusing unit 140 receives a driving force of the driving pinion 301 through a fusing unit driving gear 340. The driving force may be transmitted to the fusing unit driving gear 340 via a gear 333 engaged to the driving pinion 301.

Figure 4:
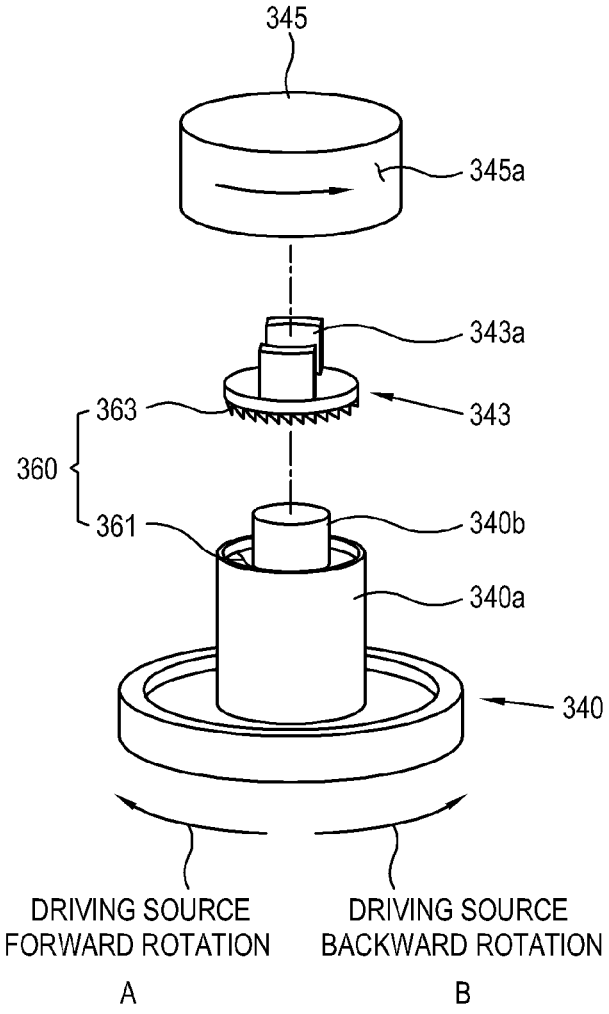
FIG. 4 is an exploded schematic perspective view of a fusing unit clutch of the image forming apparatus in FIG. 1.

As illustrated in FIG. 4, the driving force of the fusing unit driving gear 340 may be transmitted to the distributing gear 345, and a coupler 343 may be disposed between the fusing unit driving gear 340 and the distributing gear 345. Also, the fusing unit driving gear 340 may include a boss 340*a* which protrudes toward the coupler 343. The distributing gear 345 has an inner shape corresponding to the coupler 343 to rotate together with the coupler 343. That is, in exemplary embodiments, the coupler 343 includes a first end 343*a* which is coupled to an inner portion of the distributing gear 345 and a center hole (not illustrated) through which a protrusion 340*b* of the fusing unit driving gear 340 is inserted. Thus, a rotation of the distributing gear 345 corresponds to a rotation of the 340 fusing unit driving gear through the coupler 343.

In the present exemplary embodiment, the heating roller 145 and the pressing roller 143 of the fusing unit 140 may rotate by being engaged with the distributing gear 345.

The image forming apparatus 100 further includes a fusing unit clutch 360 to intermittently transmit the driving force to the distributing gear 345. That is, the fusing unit 140 rotates in the rotating direction of the fusing unit driving gear 340, which is the rotating direction of the driving pinion 301.

The fusing unit clutch 360 includes a first clutch unit 361 formed on an upper part of the boss 340*a* of the fusing unit driving gear 340, and a second clutch unit 363 formed on a surface of the coupler 343 facing the fusing unit driving gear 340. In exemplary embodiments, when the fusing unit driving gear 340 rotates in a forward direction, that is, when the driving pinion 301 rotates in the forward direction (A), the first clutch unit 361 and the second clutch unit 363 are engaged with each other to integrally rotate so that the driving force may be transmitted to the fusing unit 140 through the coupler 343 and the distributing gear 345. Accordingly, the heating roller 145 and the pressing roller 143 of the fusing unit 140 rotate as illustrated in FIG. 1. However, when the fusing unit driving gear 340 rotates in a backward direction B, that is, if the driving pinion 301 rotates in the backward direction B, the first clutch unit 361 and the second clutch unit 363 rotate idly with respect to each other, and the driving force is not transmitted to the coupler 343 and to the distributing gear 345. Accordingly, the fusing unit 140 does not rotate in the opposite direction to the direction as illustrated in FIG. 1, and maintains a stationary state. That is, the distributing gear 345 may apply an opposite force to the boss 340*a* of the fusing unit driving gear 340 to a rotational direction of the boss 340*a*.

In exemplary embodiments, a driving force transmission to the discharging rollers 153, 155, 157, and 159 may be performed through the driving pinion 301 and gears 333, 335, 336, and 337. The discharging roller 155 receives a driving force from the gear 335 to thereby actively rotate, and the other discharging roller 153 in contact therewith passively rotates. Also, as illustrated in FIG. 2, the discharging roller 157 may be coaxially connected with the gear 337 to actively drive, and the other discharging roller 159 in contact therewith passively rotates.

Figure 3:
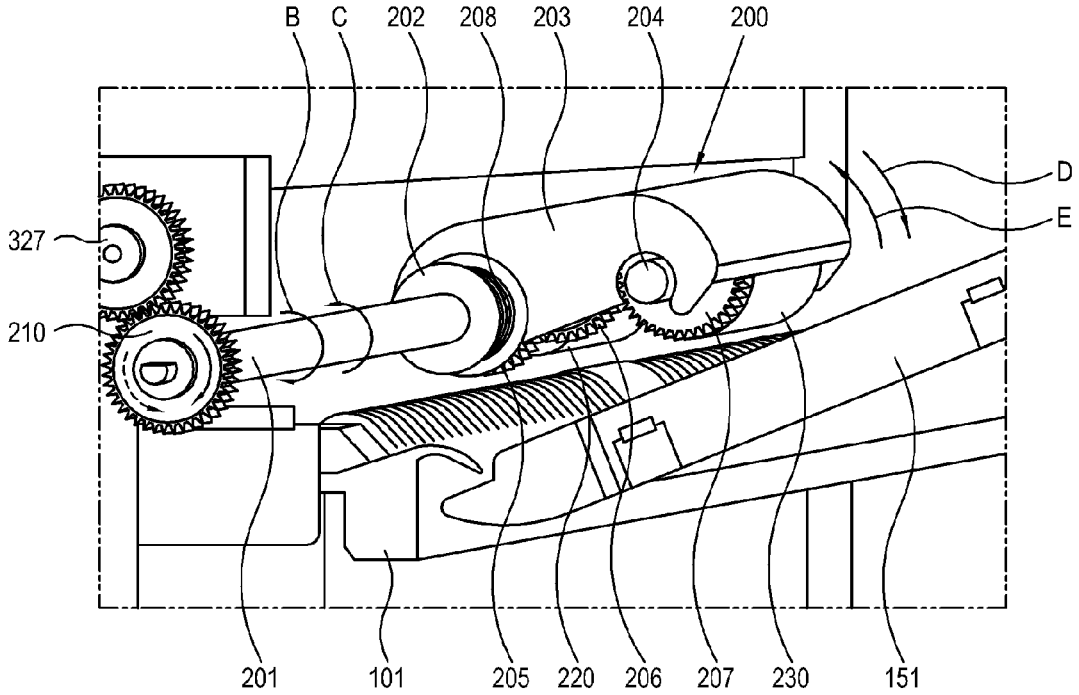
FIG. 3 is an enlarged perspective view of the image forming apparatus of FIG. 2.
Figure 7:
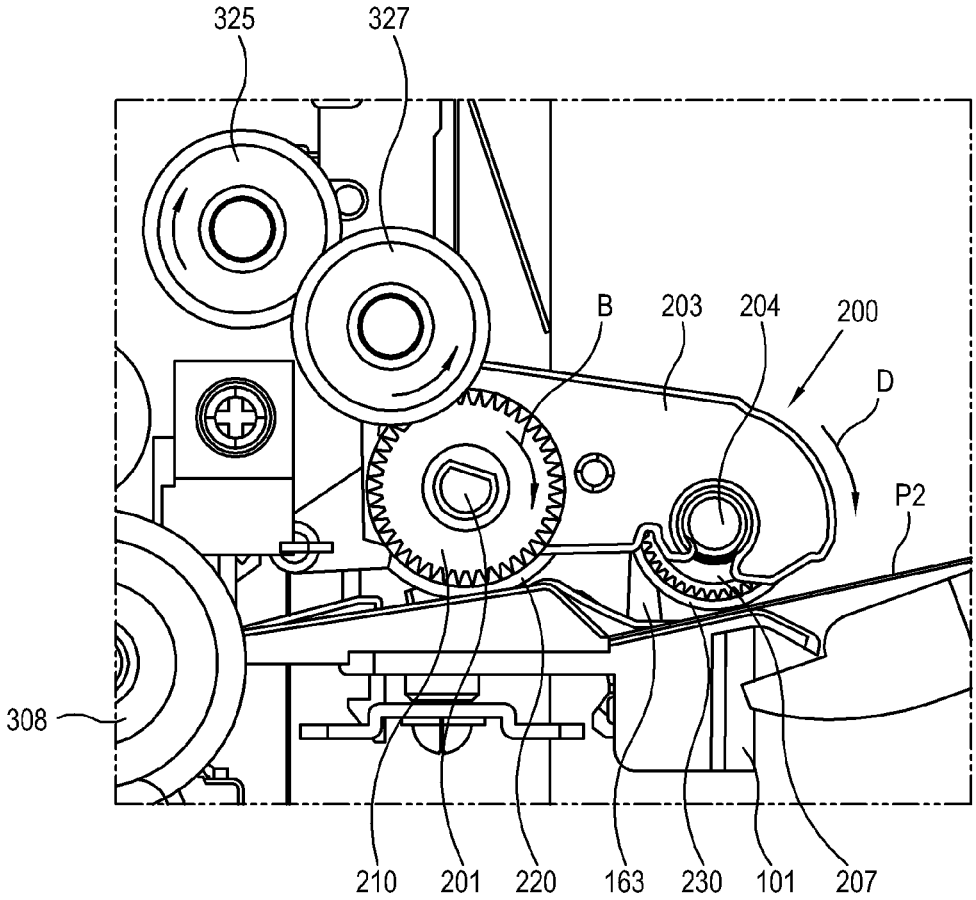
FIG. 7 is an enlarged side view of a driving force source of the image forming apparatus in FIG. 2, rotating in a forward direction.

As illustrated in FIGS. 3 and 7, the pickup unit 200 includes a pickup unit rotation shaft 201, a driven gear 210 disposed on the rotation shaft 201 to receive a driving force from the driving pinion 301, first and second pickup rollers 220 and 230 receiving the driving force from the driven gear 210 to pick up a printing medium P2 from the plate 151, and a support frame 203 to rotatably support the first and second pickup rollers 220 and 230 and to interlock with the forward and backward direction rotations of the driven gear 210 to move toward and away from the plate 151.

Figure 2A:
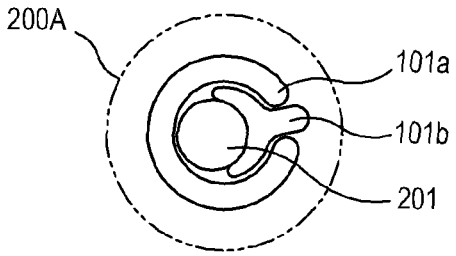
FIG. 2A is an enlarged perspective view of detail 200A of FIG. 2.

In exemplary embodiments, the rotation shaft 201 may be rotatably supported by the main body 101. In detail, as illustrated in FIGS. 2 and 2A, the rotation shaft 201 may be inserted on a rotation shaft support unit 101*a* provided to the main body 101 and including an open side, and a separation preventing unit 101*b* to prevent the rotation shaft 201 from being separated after being moved close to the open side of the main body 101. Accordingly, the pickup unit 200 may be easily disposed onto the main body 101.

The first pickup roller 220 may be disposed on the rotation shaft 210 to correspond to a rotation of the rotation shaft 210.

In exemplary embodiments, the second pickup roller 230 may disposed on a roller shaft 204 parallel to the rotation shaft 210, and the roller shaft 204 may be rotatably supported by the support frame 203.

A first pickup gear 205 which integrally rotates with the rotation shaft 201 may be disposed inside the support frame 203, and a second pickup gear 207 may be disposed on the roller shaft 204. A gear 206 may be disposed between the first pickup gear 205 and the second pickup gear 207 to transmit a rotation force of the first pickup gear 205 to the second pickup gear 207. Accordingly, the first pickup roller 220 and the second pickup roller 230 may rotate in a same direction.

A disk 202 which integrally rotates with the rotation shaft 201 may be disposed on the rotation shaft 201, and a torsion spring 208 may be disposed between the disk 202 and the support frame 203. In exemplary embodiments, when the disk 202 rotates in a forward direction (B), the rotation force is transmitted to the support frame 203 by the torsion spring 208 so that the support frame 203 may rotate in a forward direction (D). Accordingly, when the support frame 203 is spaced apart from the plate 151, the support frame 203 rotates in the direction (D) to approach or move toward the plate 151 about the rotation shaft 201. The second pickup roller 230 also approaches the plate 151 by the rotation of the support frame 203 to become capable of picking up a printing medium P2 disposed on the plate 151. In the current exemplary embodiment, when the support frame 203 continuously receives the rotating force in the approaching direction (D) by the torsion spring 208, the force may be excessively applied to the plate 151. However, when the support frame 203 receives a repulsion force from the plate 151, the torsion spring 208 rotates idly inside the rotation shaft 201 to prevent the rotation moment of the rotation shaft 201 from being transmitted to the support frame 203. In exemplary embodiments, the rotation shaft 201 is disposed eccentrically within the rotation shaft support unit 101*a*. That is, a center of the rotation shaft 201 may not correspond to a center of the rotation shaft support unit 101*a* so that a weight and position of the pickup unit 200 may be more easily controlled.

Figure 8:
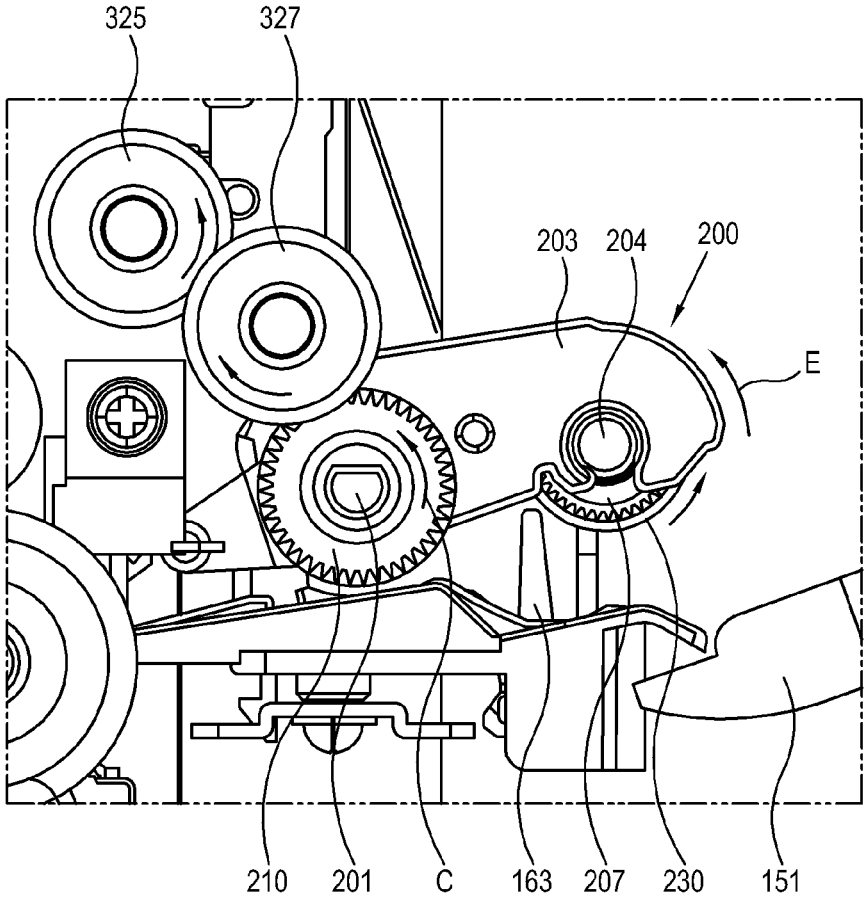
FIG. 8 is an enlarged side view of the driving force source of the image forming apparatus in FIG. 2, rotating in a backward direction.

In alternative exemplary embodiments, when the rotation shaft 201 rotates in a backward direction (C), as illustrated in FIGS. 3 and 8, the support frame 203 rotates together in a direction (E) to thereby be separated from the plate 151 by the torsion spring 208.

Here, the driving force transmission by the torsion spring 208 is exemplary described. However, the present general inventive concept is not limited thereto. That is, in alternative exemplary embodiments, various changes may be applied to the driving force transmission process.

An exemplary embodiment of a driving force transmission process from the driving pinion 301 to the pickup unit 200 will now be described. A driving force may be transmitted in an order of the driving pinion 301, the gear 302, the developing unit driving gear 310, the gear 303, the registration roller electronic clutch 330, and the gears 313, 309, 308, 315, 316, 317, and 318, and may then be transmitted up to a pickup clutch 370. Next, the driving force may be transmitted up to the driven gear 210 from the pickup clutch 370 via gears 324, 326, and 328 disposed on a rear surface of the main body 101, gears 323 and 325, and the blocking gear 327.

In the current exemplary embodiment, the pickup clutch 370 may be disposed on a driving force transmission path from the driving pinion 301 to the driven gear 210 to intermittently transmit the driving force of the driving pinion 301 to the driven gear 210. In exemplary embodiments, the pickup clutch 370 may include an electronic clutch.

In exemplary embodiments, when the driving pinion 301 rotates in the forward direction (A), the driven gear 210 and the pickup unit rotation shaft 201 rotate in the opposite direction (B) in FIG. 3 to the rotation direction of the driving pinion 301. As described above, in a viewpoint of the pickup unit 200, the rotating in a forward direction means rotating to transport a printing medium disposed on the plate 151 to the image forming unit 106. That is, if the driving pinion 301 rotates in the forward direction (A), the driven gear 210, the rotation shaft 201 and the first and second pickup rollers 220 and 230 of the pickup unit 200 also rotate in the forward direction (B) in FIG. 3, and the support frame 201 of the pickup unit 200 rotates in the direction (D) to thereby move toward or approach the plate 151.

On the contrary, if the driving pinion 301 rotates in the backward direction, they rotate in an opposite direction as described above, and the support frame 203 rotates in the direction (E) to thereby be spaced apart from the plate 151.

Here, the blocking gear 327 prevents the support frame 203 spaced apart from the plate 151 from rotating to approach or move toward the plate 151. In more detail, although a power supply is broken to the driving motor so that the driving pinion 301 stops, since the blocking gear 327 is engaged with the gear 325 for transmitting the driving force of the driving pinion 301, the rotation of the blocking gear 327 may be prevented. That is, an opposite force may be applied to the blocking gear 327 against a rotational direction in which the support frame 203 rotates about the rotation shaft 201 toward the plate 151. Accordingly, the rotation of the driven gear 210 engaged to the blocking gear 327 may also prevented, and the rotation of the pickup unit 200 may also be prevented.

As illustrated in FIG. 6, the image forming apparatus 100 according to the previous exemplary embodiment of the present general inventive concept may further include the pickup clutch 370, the electric power supplying unit 160 to supply an electric power to the registration roller electronic clutch 330 and the driving source 190, a sensor 163 to sense whether there is a printing medium disposed on the plate 151 or not, a control unit 180 to control the electric power supplying unit 160, and an image forming unit 106 to form an image on the printing medium. In exemplary embodiments, the image forming unit 106 may include a developing cartridge 120 which forms the image on the printing medium.

If there is a printing command, the control unit 180 controls the electric power supplying unit 160 to supply an electric power to the driving source 190 so that the driving pinion 301 of the driving source 190 may be rotated in the forward direction (A). Also, if the sensor 163 senses that there is a printing medium disposed on the plate 151, the control unit 180 supplies an electric power to the pickup clutch 370.

Accordingly, the pickup unit 200 rotates in the forward direction (B) in FIGS. 1 and 3 so that the printing medium disposed on the plate 151 may be picked up to be transported to the image forming unit 106.

After the pickup unit 200 picks up the printing medium, the control unit 180 controls the electric power supplying unit 160 so that an electric power may not be supplied to the registration roller electronic clutch 330. Accordingly, the registration roller 105 in FIG. 1 may maintain a stationary state so that the printing medium may be aligned. After the printing medium is aligned, the control unit 180 controls the electric power supplying unit 160 to supply the electric power to the registration roller electronic clutch 330, and accordingly, the aligned printing medium may be transported to the image forming unit 106.

After the image forming unit 106 forms an image on the printing medium, the discharging rollers 153, 155, 157, and 159 discharge the printing medium to an external environment, thereby completing the printing process. After the printing is completed, the control unit 180 controls the electric power supplying unit 160 so that the driving pinion 301 may rotate in the backward direction. That is, the control unit 180 controls the electric power supplying unit 160 to apply voltage having the opposite polarity to the driving source 190 so that the driving pinion 301 may rotate in the backward direction. As the driving pinion 301 rotates in the backward direction, the driven gear 210 rotates in the backward direction (C) in FIG. 3, and the support frame 203 rotates in the direction (E) to be spaced apart from the plate 151. Accordingly, an input space in which a printing medium can be input may be provided between the pickup unit 200 and the plate 151, thereby improving user convenience.

As necessary, the control unit 180 may control the electric power supplying unit 160 so that the input space may be provided, that is, the driving pinion 301 can rotate in the backward direction every printing completion.

Also, as necessary, if there is no printing medium disposed on the plate 151 in a sensing result of the sensor 163, the control unit 180 may control the electric power supplying unit 160 so that the input space may be provided.

Although the driving pinion 301 rotates in the backward direction, the driving force transmission to the image forming unit 106 is broken by the developing unit clutch 353 and the fusing unit clutch 360. Accordingly, problems such as a developer having leaks or being damaged due to the backward direction rotations of the developing roller 125 or the image carrying body 123 configuring the image forming unit 106 may be prevented or substantially reduced.

Figure 9:
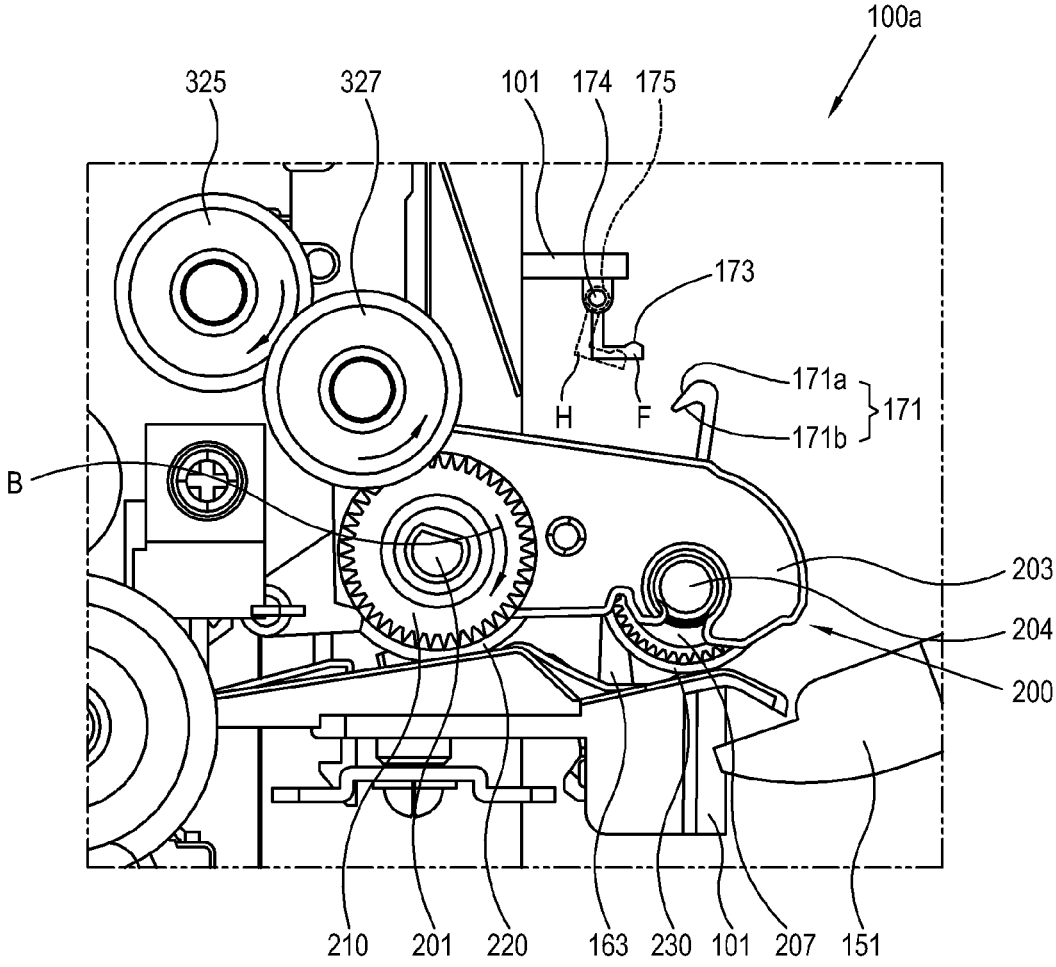
FIG. 9 is an enlarged side view of an image forming apparatus according to another exemplary embodiment of the present general inventive concept.
Figure 10:
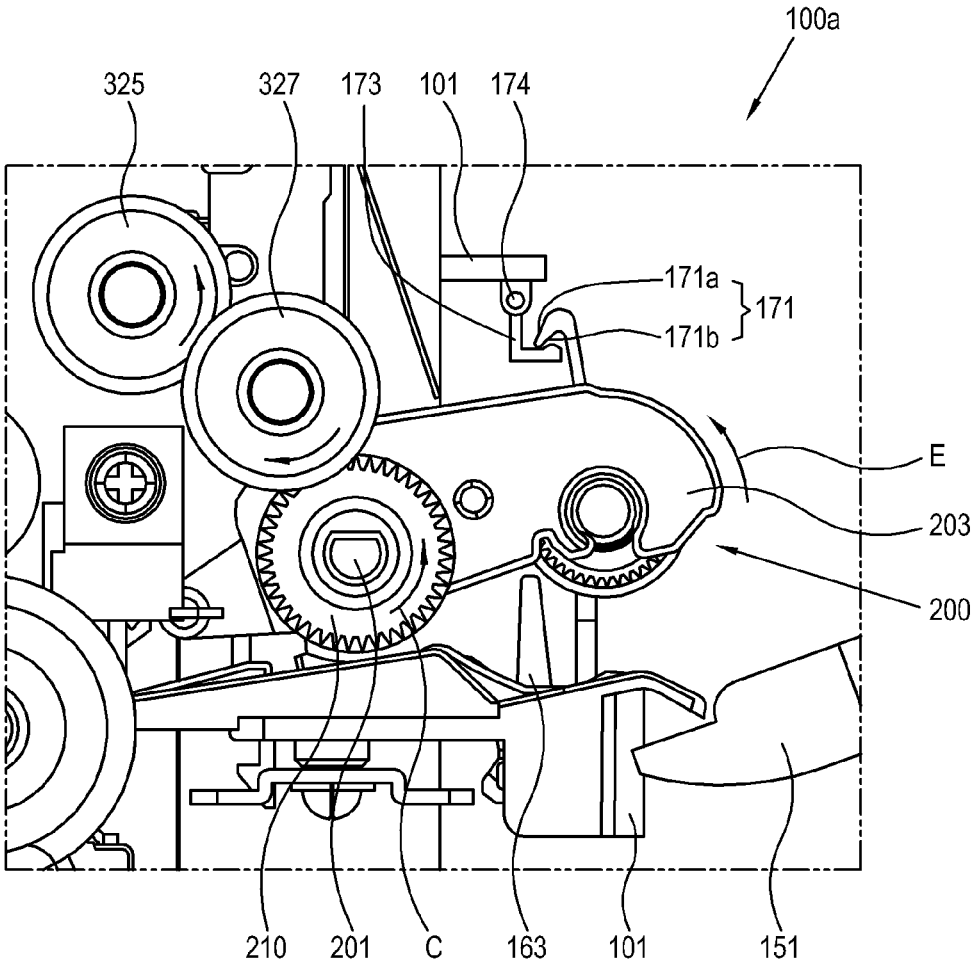
FIG. 10 is an enlarged side view of a driving force source of the image forming apparatus in FIG. 9, rotating in a backward direction.

As illustrated in FIGS. 9 and 10, an image forming apparatus 100*a* according to another exemplary embodiment of the present general inventive concept may further include an engagement unit 171 and an engagement threshold 173 in comparison to the image forming apparatus 100 according to the previous exemplary embodiment described above.

The engagement threshold 173 rotates about a hinge pivot 174 disposed on a main body 101. The engagement threshold 173 rotates about the hinge pivot 174 between a first position F engaged with the engagement unit 171 and a second position H released from the engagement unit 171.

Here, the image forming apparatus 100*a* may further include an elastic member 175 elastically biasing the engagement threshold 173 toward the first position F. The elastic member 175 may include a torsion coil spring disposed on the hinge pivot 174.

Here, a rotation moment applied to the engagement threshold 173 by an elastic force of the elastic member 175 may be larger than a rotation moment by a weight of a pickup unit 200, and may be less than a rotation moment which a support frame 203 receives by a forward direction rotation (B) of a driven gear 210. That is, a combination of the engagement threshold 173 and 171 may generate an opposite force which is to be applied to the support frame 203 to reduce a rotating force of the support frame 203 with respect to the rotation shaft 201 or may prevent the rotating force on the support frame 203 from rotating. Accordingly, the engagement threshold 173 and the engagement unit 171 may maintain the engagement coupling, and the engagement coupling may be easily withdrawn if the driven gear 210 rotates in the forward direction (A)

FIG. 9 illustrates a state in which the driven gear 210 rotates in the forward direction (B) so that the support frame 203 may approach or move toward a plate 151 to pick up a printing medium disposed on the plate 151. (See FIG. 12).

The engagement unit 171 may be disposed on the support frame 203. Also, the engagement unit 171 includes an upper inclined surface 171*a* rotating the engagement threshold 173 to the second position H if the support frame 203 rotates in a distanced direction E distanced from the plate 151, and a lower inclined surface 171*b* rotating the engagement threshold 173 to the second position H if the support frame 203 rotates in an approaching direction (D) approaching the plate 151.

After the printing of a printing medium is completed or if a sensor 163 senses that there is no printing medium, the driven gear 210 rotates in the backward direction (C) by a control of a control unit 180, and the support frame 203 rotates in the distanced direction (E). The engagement unit 171 disposed to the support frame 203 also rotates in the distanced direction (E), and the engagement threshold 173 rotates to the second position H as the upper inclined surface 171*a* of the engagement unit 171 contacts to the engagement threshold 173. When the contact between the engagement threshold 173 and the engagement unit 171 is withdrawn, the engagement threshold 173 rotates to the first position F by the elastic member 175, and the engagement unit 171 is engaged to the engagement threshold 173 as illustrated in FIG. 10. Accordingly, the support frame 203 may be prevented from rotating in the approaching direction (D).

As illustrated in FIG. 10, if the driven gear 210 rotates in the forward direction (B) in FIG. 9 again when the engagement unit 171 is engaged to the engagement threshold 173, the support frame 203 becomes to receive a rotation moment to rotate in the approaching direction (D), and the upper inclined surface 171*b* of the engagement unit 171 pushes the engagement threshold 173 to rotate the engagement threshold 173 to the second position H, and accordingly, the engagement unit 171 may be released from the engagement threshold 173.

Figure 11:
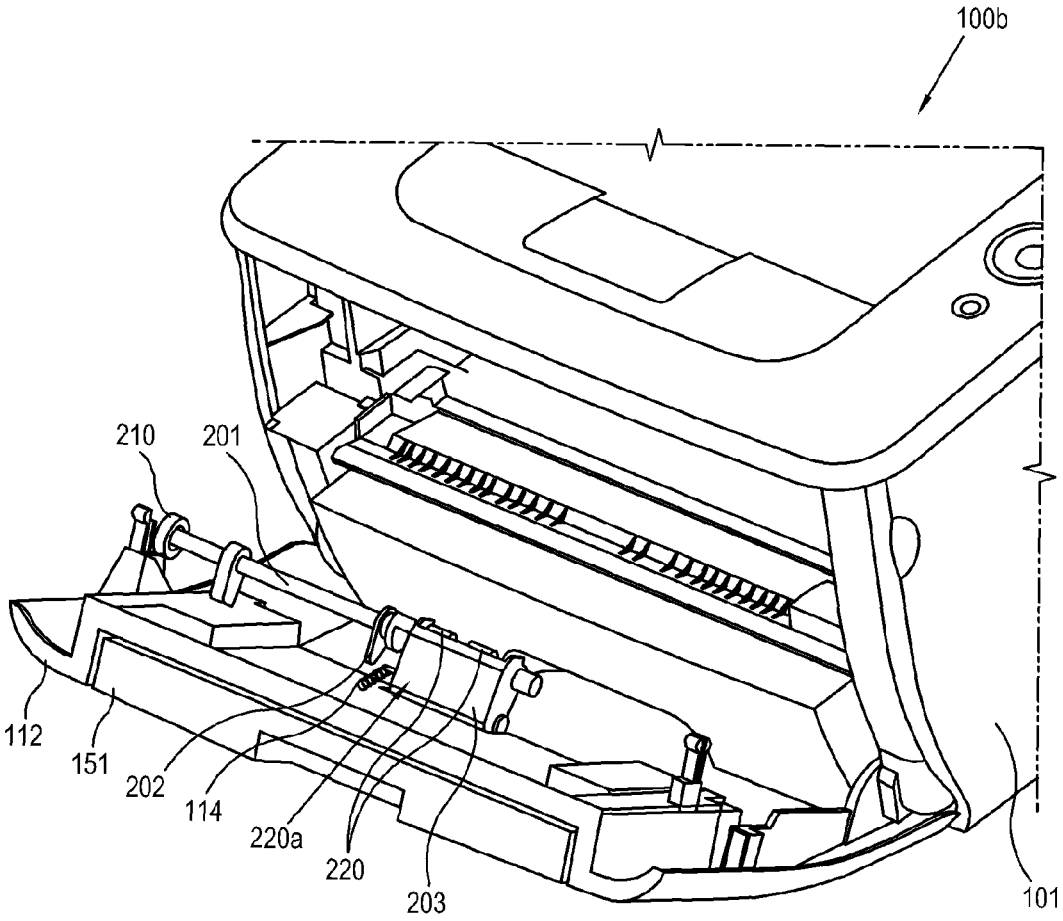
FIG. 11 is a schematic perspective view of an image forming apparatus according to another exemplary embodiment of the present general inventive concept.
Figure 12:
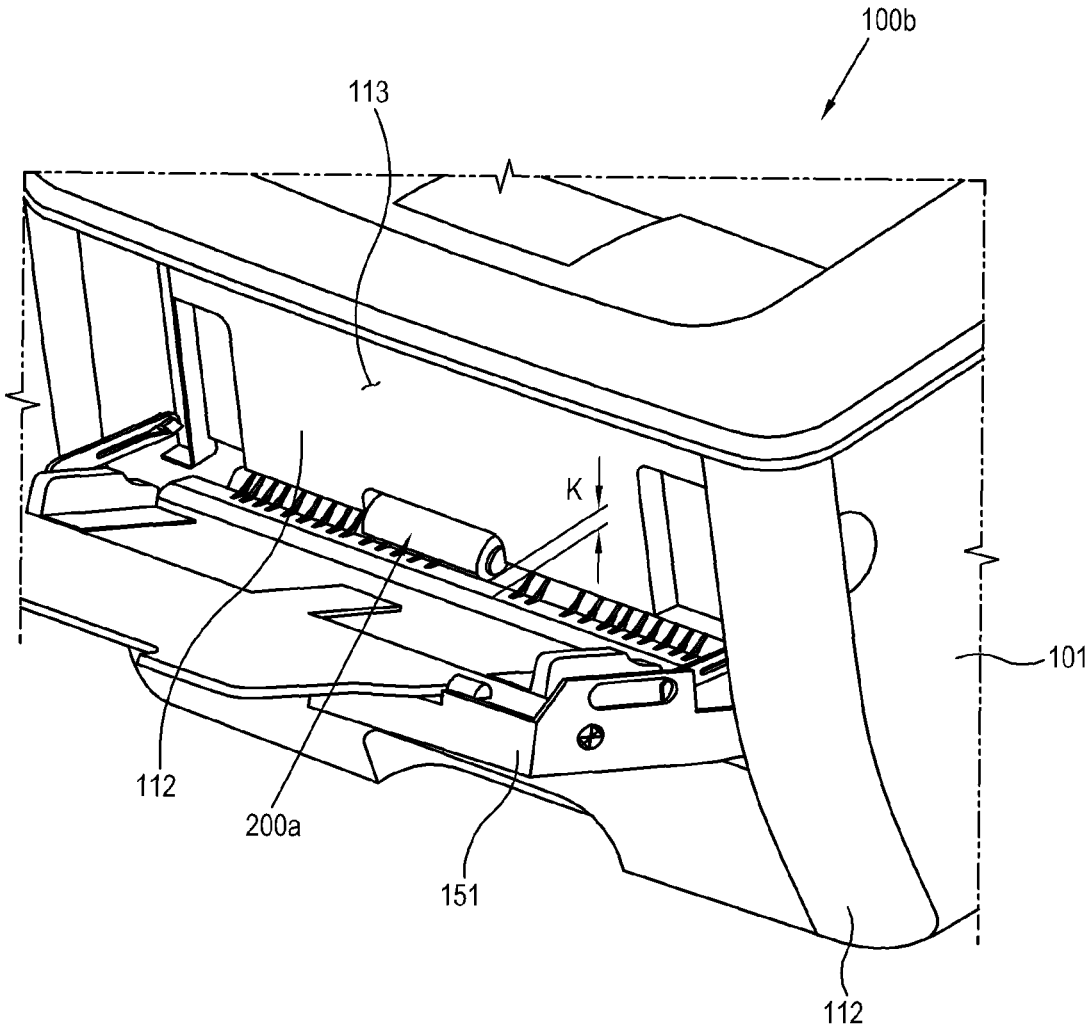
FIG. 12 is a schematic perspective view illustrating a state in which a developing cartridge mounting cover in FIG. 11 is closed and a plate is opened.

As illustrated in FIGS. 11 and 12, in an image forming apparatus 100*b* according to a another exemplary embodiment of the present general inventive concept, a pickup unit 200*a* may be disposed on a cover 112. The cover 112 is rotatably mounted on the main body 101 to open or close an opening through which a printing medium feeding element is exposed to receive a print medium from the pickup unit 200 or at least one paper feeding unit of the image forming apparatus 100*b*.

A driven gear 210 of the pickup unit 200*a* may be engaged to a blocking gear 327 mounted in FIG. 2 if the cover 112 rotates to be in a closed state to cover the opening. Here, the blocking gear 327 in FIG. 2 and gears for a driving force transmission are not illustrated in FIG. 11 for convenience.

In exemplary embodiments, the pickup unit 200*a* may have the same configurations as the pickup unit 200 according to the previous exemplary embodiment. An end part of a rotation shaft 201 of the pickup unit 200*a* may be supported to an inner side of the cover 112, and a support frame 203 of the pickup unit 200*a* and the cover 112 may be coupled to each other by a coil spring 114. The coil spring 114 may elastically bias the pickup unit 200*a* so that there may be an input space K in which a printing medium is input between the support frame 203 and a plate 151.

An elastic force of the coil spring 114 may be provided to be appropriate so that the support frame 203 may rotate to approach the plate 151 if a driven gear 210 rotates in a forward direction and the pickup unit 200*a* rotates in a forward direction. Also, once the pickup unit 200*a* approaches the plate 151, the support frame 203 is incapable of being spaced apart from the plate 151 by the elastic force of the coil spring 114 until the driven gear 210 rotates in a backward direction. If the driven gear 210 rotates in the backward direction, the pickup unit 200*a* may easily rotate to be spaced apart from the plate 151 by the elastic force of the coil spring 114. The coil spring 114 has sufficient elastic force so as to maintain a distance while in a rotating state. However, the present general inventive concept is not limited thereto. That is, in exemplary embodiments, the coil spring 114 may generate or apply an opposite force to the pickup unit 200*a* against a rotating direction of the pickup unit 200*a* to pickup the print medium from the plate 151.

In case of the image forming apparatus 100 according to the previous exemplary embodiment, the pickup unit 200 may be disposed to the main body 101. On the contrary, in an exemplary embodiment, the pickup unit 200*a* may be disposed on the cover 112. The coil spring 114 may generate or apply an opposite force to the pickup unit 200*a* against a rotating direction of the pickup unit 200*a* to pickup the print medium.

The cover 112 opens and closes a front surface of the image forming apparatus 100*b* to detachably mount a developing cartridge 120. That is, a user may open and close the cover 112 to replace or repair the developing cartridge 120.

In exemplary embodiments, the cover 112 may be rotatably coupled to a lower part of a main body 101.

A plate 153 may be rotatably coupled to the cover 112. The cover 112 may be formed with an accommodating space 113 to accommodate the plate 153 when the plate 153 is folded. As illustrated in FIG. 12, if a user desires a manual printing medium supplying, and rotates the plate 153 downward with respect to the cover 112 when the cover 112 closes the front surface of the main body 101, a printing medium may then be loaded on the plate 153.

As described above, it is exemplarily described that the single motor drives the total image forming apparatus 100. However, the present general inventive concept is not limited thereto. That is, in alternative exemplary embodiments, a separate driving motor driving only the pickup unit 200 may be further added as necessary.

Figure 13:
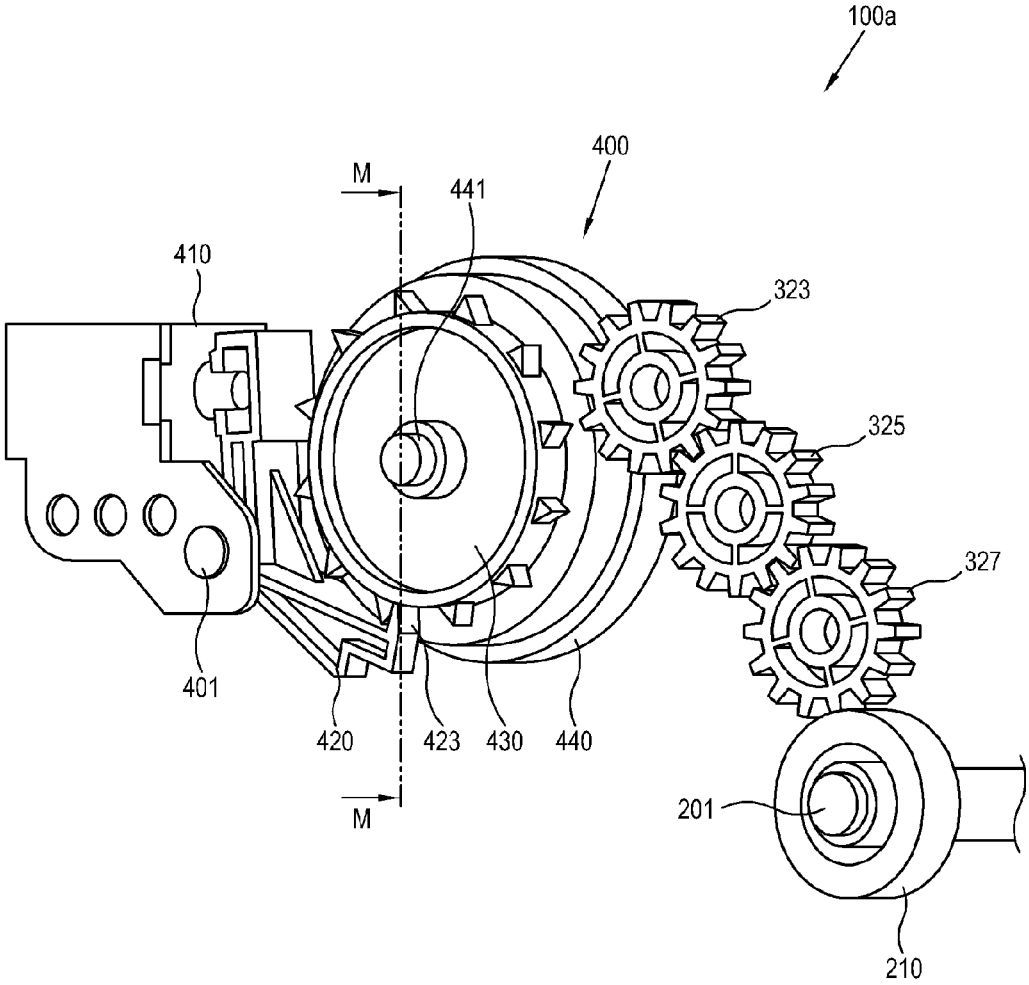
FIG. 13 is an enlarged partial perspective view of an image forming apparatus according to a another exemplary embodiment of the present general inventive concept.

As illustrated in FIG. 13, an image forming apparatus 100*a* according to a another exemplary embodiment of the present general inventive concept may employ a pickup unit driving force regulating device 400 instead of the pickup clutch 370 as described above.

Figure 14:
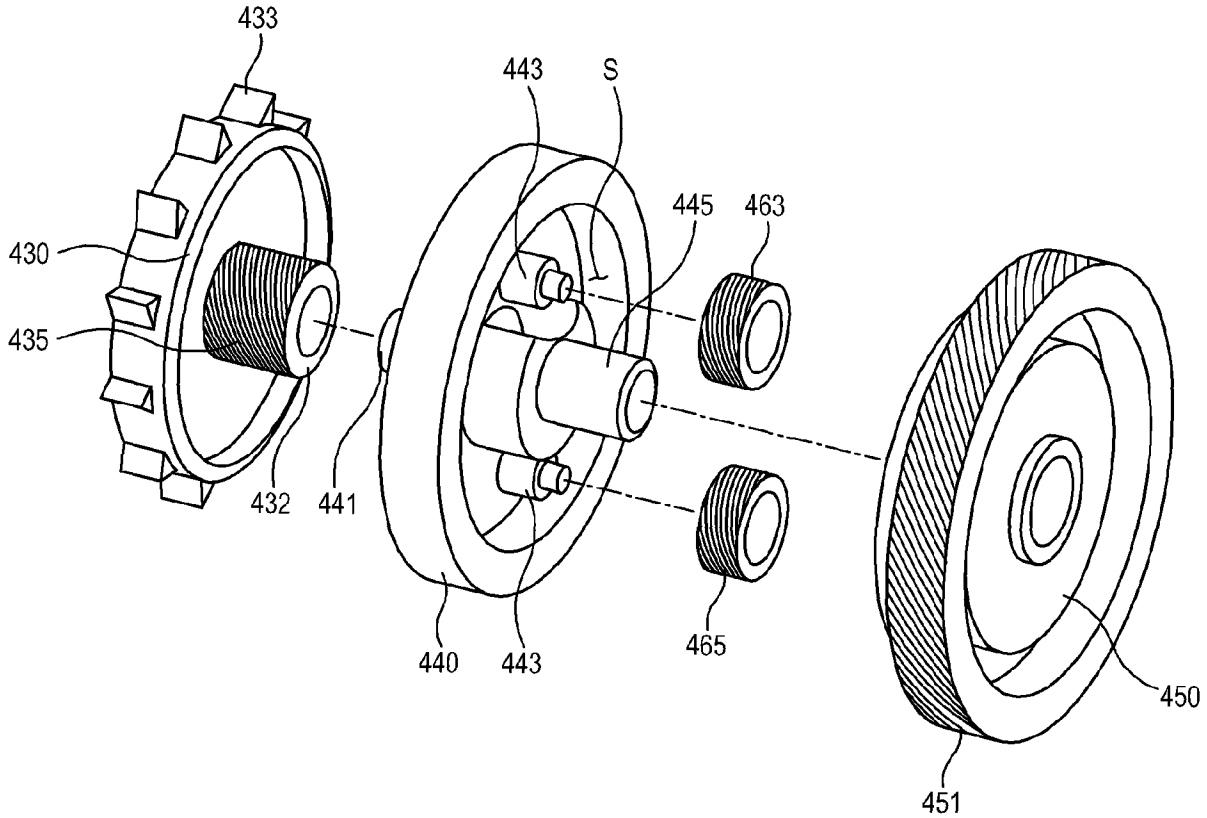
FIG. 14 is an exploded perspective view of the image forming apparatus of FIG. 13.
Figure 20:
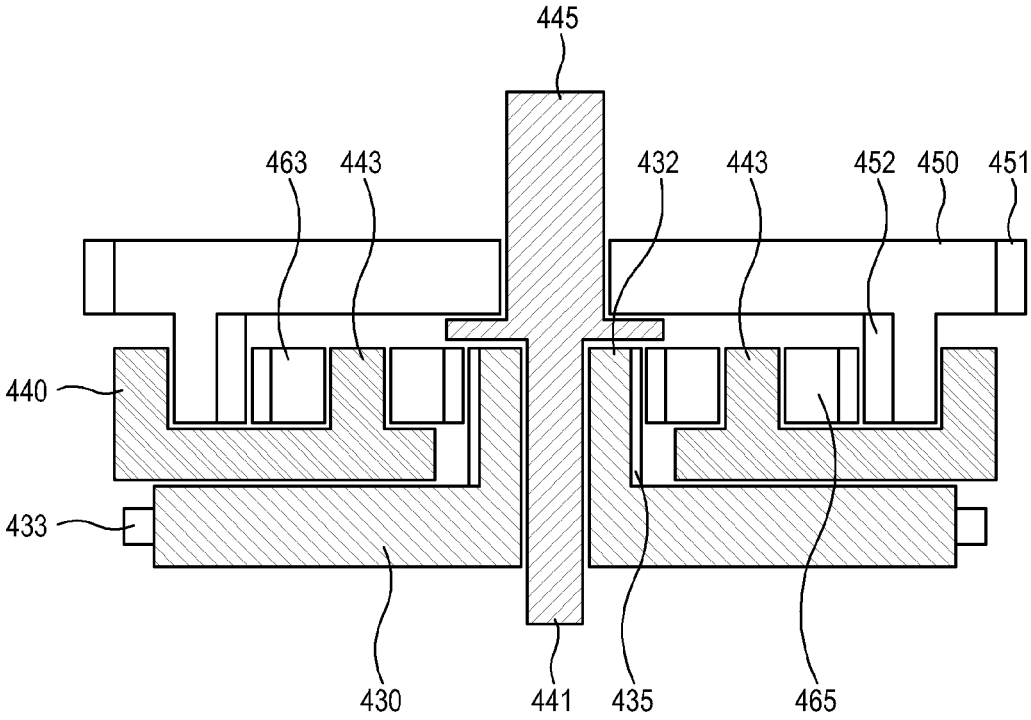
FIG. 20 is a schematic sectional view taken along line M-M in FIG. 13.

FIG. 14 is an exploded perspective view exploding a sun gear 430, a support gear 440, and a ring gear 450 of the pickup unit driving force regulating device 400 in FIG. 13, and FIG. 20 is an enlarged sectional view taken along line M-M in FIG. 13.

As illustrated in FIGS. 13, 14, and 20, the pickup unit driving force regulating device 400 includes a lever driving unit 410, a lever 420, the sun gear 430, the support gear 440, and the ring gear 450.

The ring gear 450 may be engaged to a gear 315 illustrated in FIG. 1 to receive a driving force from a driving source 190 in FIG. 6.

As illustrated in FIGS. 14 and 20, the ring gear 450 includes a ring gear outer teeth 451 engaged with the gear 315 in an outer surface thereof, and includes an inner teeth in an inner part thereof to be engaged with planetary gears 463 and 465.

As illustrated in FIGS. 14 and 20, the support gear 440 includes a stud 443 to rotatably support the planetary gears 463 and 465. An outer surface of the support gear 440 may be formed with teeth engaged to the gear 323 to transmit a driving force to a driven gear 210 of a pickup unit 200. The stud 443 is disposed to an inner space S inside the support gear 440 so that the planetary gears 463 and 465 may be accommodated inside the support gear 440.

Figure 18:
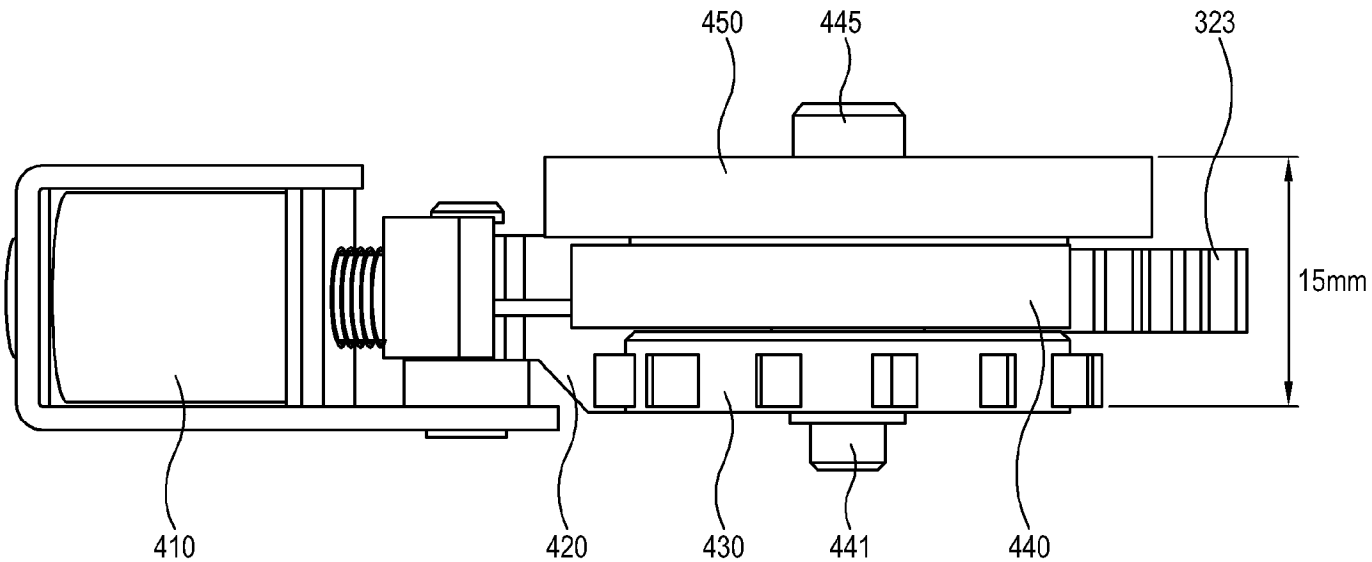
FIG. 18 is an enlarged top plan view of the image forming apparatus of FIG. 13.

Accordingly, as illustrated in FIG. 18, a total thickness of the sun gear 430, the support gear 440, and the ring gear 450 may be about 15 mm. Accordingly, a volume of the pickup unit driving force regulating device 400 may be reduced, thereby making a final product relatively small. However, the present general inventive concept is not limited thereto.

The support gear 440 includes a ring gear boss 445 protruding toward the ring gear 450, and the ring gear 450 may be inserted on the ring gear boss 445. The support gear 440 includes a sun gear boss 441 protruding toward the sun gear 430, and the sun gear 430 may be inserted on the sun gear boss 441. Accordingly, the sun gear 430 and the ring gear 450 may be rotatably supported by the support gear 440.

Here, the ring gear boss 445 and the sun gear boss 441 may extend toward a central rotation axial direction of the support gear 440. Accordingly, the sun gear 430, the support gear 440, and the ring gear 450 may rotate about the same rotation axis.

The sun gear 430 includes a protruding unit 432 protruding toward the sun gear boss 441, and an outer surface of the protruding unit 432 may be formed with a sun gear teeth 435.

When being inserted on the sun gear boss 441, the protruding unit 432 is accommodated in the inner space S of the support gear 440, and may be interposed between the pair of planetary gears 463 and 465. Accordingly, the sun gear teeth 435 formed on the outer surface of the protruding unit 432 may become engaged with the pair of planetary gears 463 and 465.

Also, an outer surface of the sun gear 430 may be formed with a lever contact teeth 433 to contact the lever 420.

Figure 15:
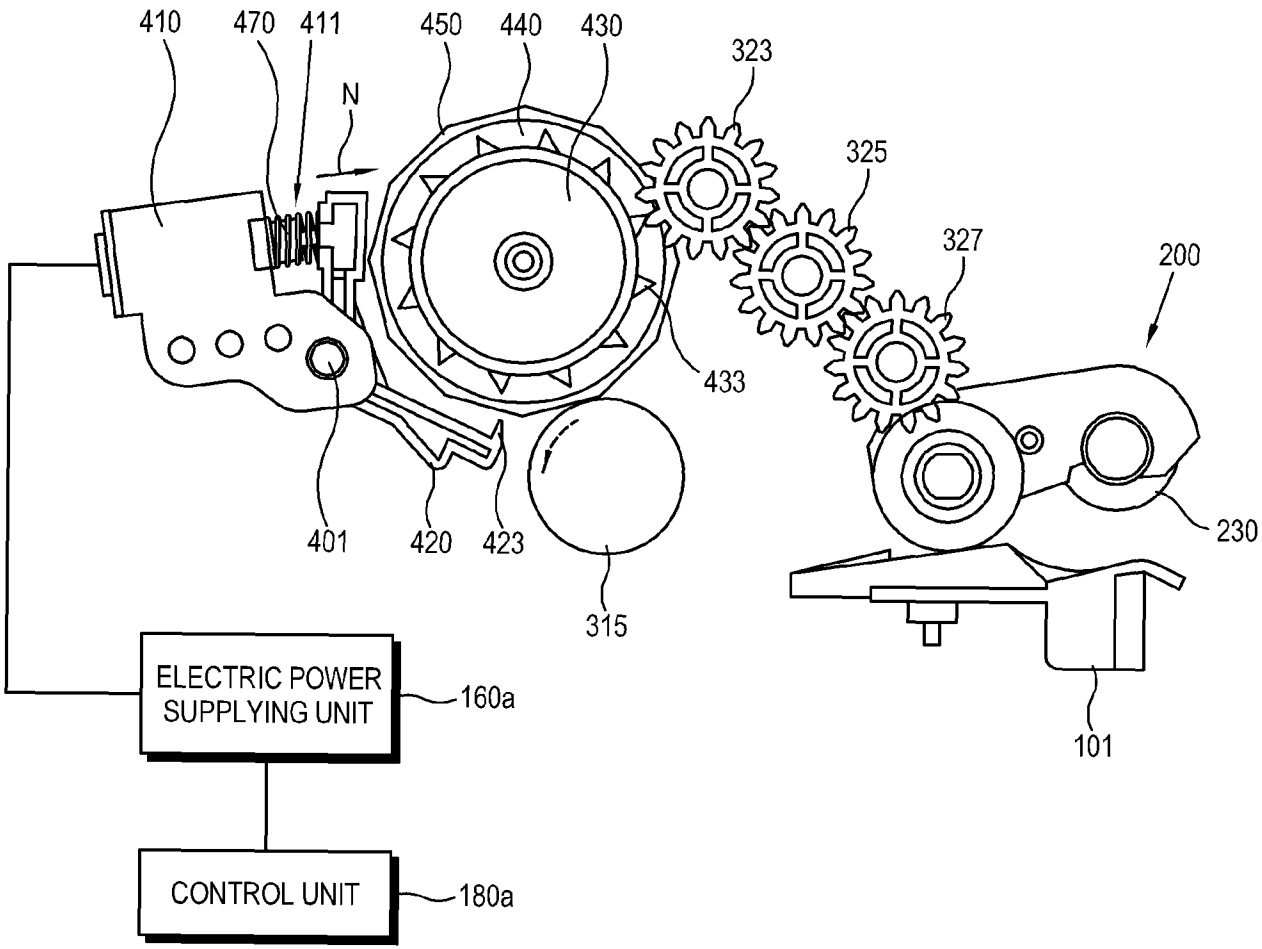
FIGS. 15 and 16 are schematic side views illustrating a driving force regulating process of a driving force regulating unit of the image forming apparatus in FIG. 13.
Figure 16:
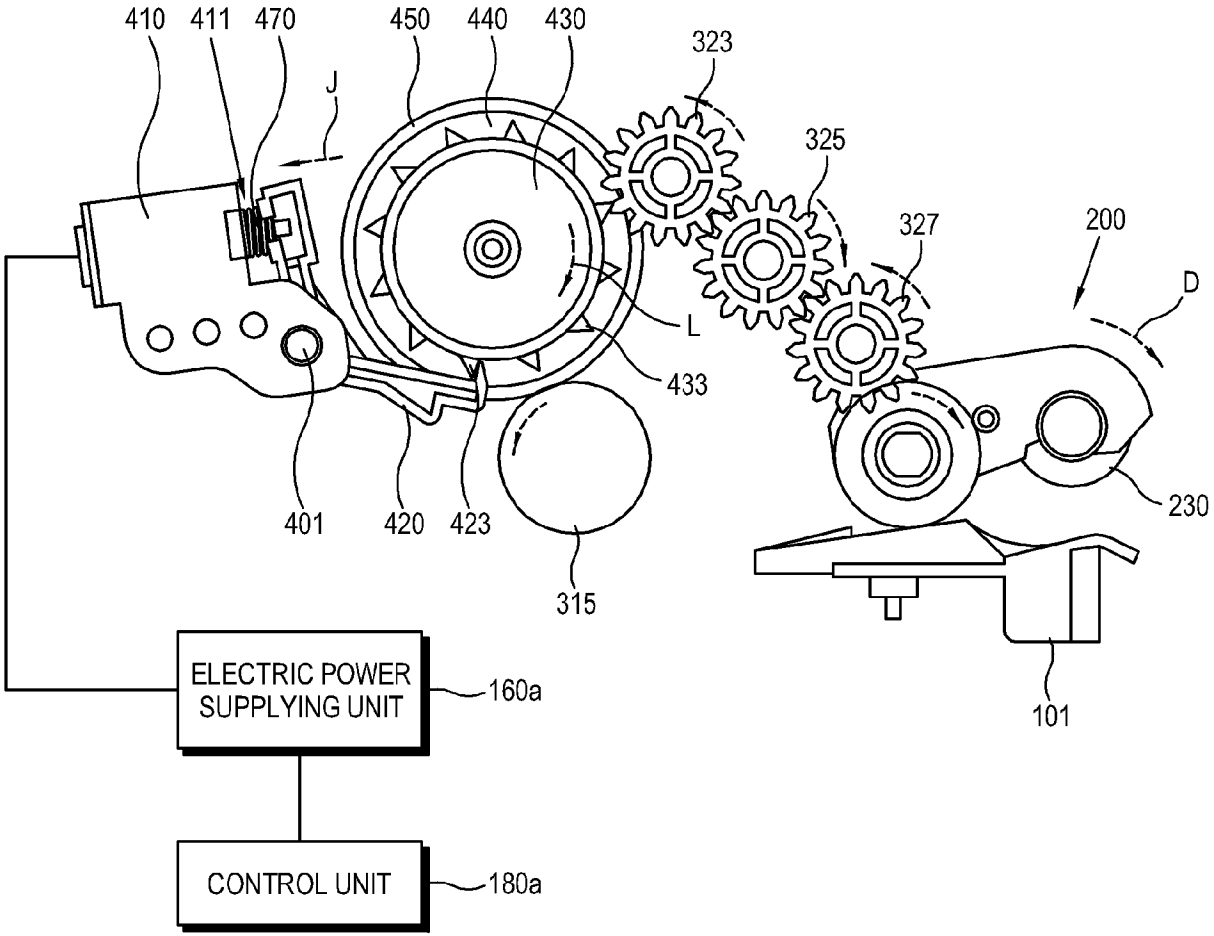

As illustrated in FIGS. 13, 15, and 16, the lever 420 rotates about a hinge pivot 401, and an end part of the lever 420 may be formed with a protrusion 423 engaged with the lever contact teeth 433.

The lever 420 rotates between a first position (the position of the lever 420 illustrated in FIG. 16) in which the protrusion 423 and the lever contact teeth 433 are engaged with each other, and a second position (the position of the lever 420 illustrated in FIG. 15) in which the protrusion 423 and the lever contact teeth 433 are released from each other.

If the lever 420 is positioned in the first position, the protrusion 423 and the lever contact teeth 433 are engaged with each other to prevent a free rotation of the sun gear 430, and if the lever 420 is positioned in the second position, the protrusion 423 and the lever contact teeth 433 are released from each other so that the sun gear 430 may freely rotate.

Here, the lever 420 is exemplarily illustrated to rotate. Alternatively, other type moving mechanisms such as a sliding movement instead of the rotation movement may be employed thereto as long as the lever 420 may move between the first position and the second position.

The lever driving unit 410 may include a solenoid 411. Alternatively, other known driving units capable of moving the lever 420 between the first position and the second position may also be employed.

In exemplary embodiments, the solenoid 411 drives the lever 420 to move between the first position and the second position. As necessary, the pickup unit driving force regulating device 400 may further include an elastic member 470 in FIG. 17 to elastically bias the lever 420 so that the lever 420 may maintain one position of the first position and the second position. However, the present general inventive concept is not limited thereto. That is, in exemplary embodiments, the elastic member 470 may generate or apply an opposite force to the lever 420 in opposite directions to the first position or the second position.

Hereinafter, a driving force regulating process of the pickup unit driving force regulating device 400 having the above configuration will be described by referring to FIGS. 15 and 16.

As illustrated in FIG. 15, a control unit 180*a* controls an electric power supplying unit 160*a* so that an electric power may be prevented from being supplied to the solenoid 411 if it is unnecessary to supply a printing medium to an image forming unit 106, that is, if it is unnecessary to drive the pickup unit 200. Since the solenoid 411 does not apply an external force to the lever 420, the lever 420 may be positioned in the second position by an elastic force N of the elastic member 470.

Accordingly, the sun gear 430 may be capable of freely rotating so that the sun gear 430 and the ring gear 450 may rotate together. Also, since the support gear 440 is connected to the pickup unit 200 by gears 323, 325, and 327, the support gear 440 does not rotate to maintain a stationary state due to a load by the pickup unit 200. Accordingly, a driving force of a driving source 190 in FIG. 6 may not be transmitted to the pickup unit 200.

Here, a process that the driving force is transmitted from the ring gear 450 to the support gear 440 depending on the free rotation of the sun gear 430 will be described more in detail by referring to FIGS. 19A and 19B.

Figure 19A:
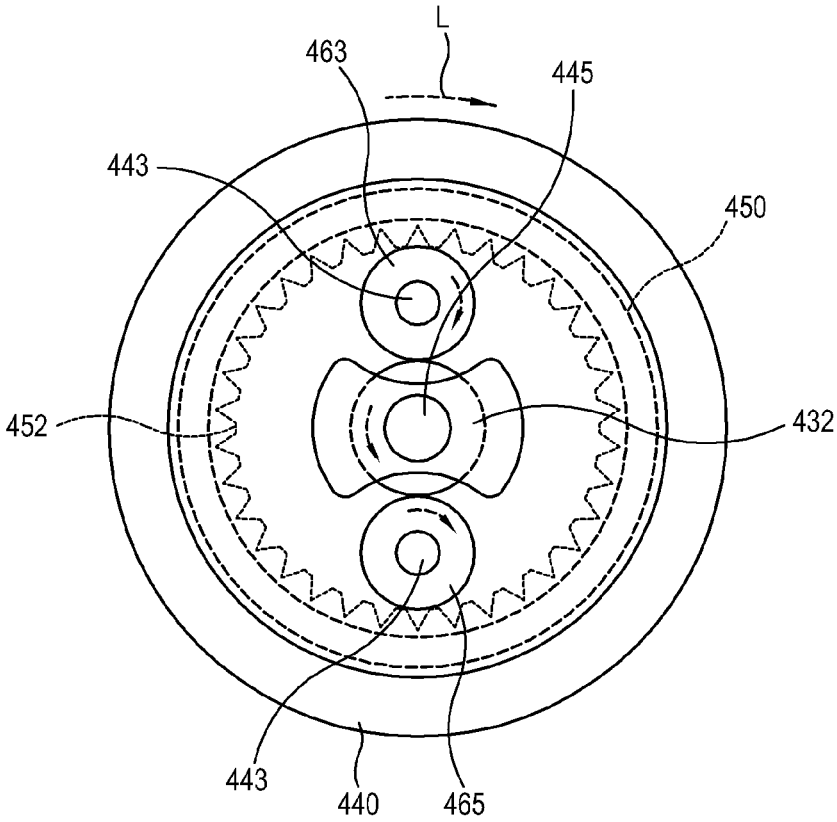
FIG. 19A illustrates a driving force transmitting process under a state in which a sun gear in FIG. 13 is allowed to rotate freely.
Figure 19B:
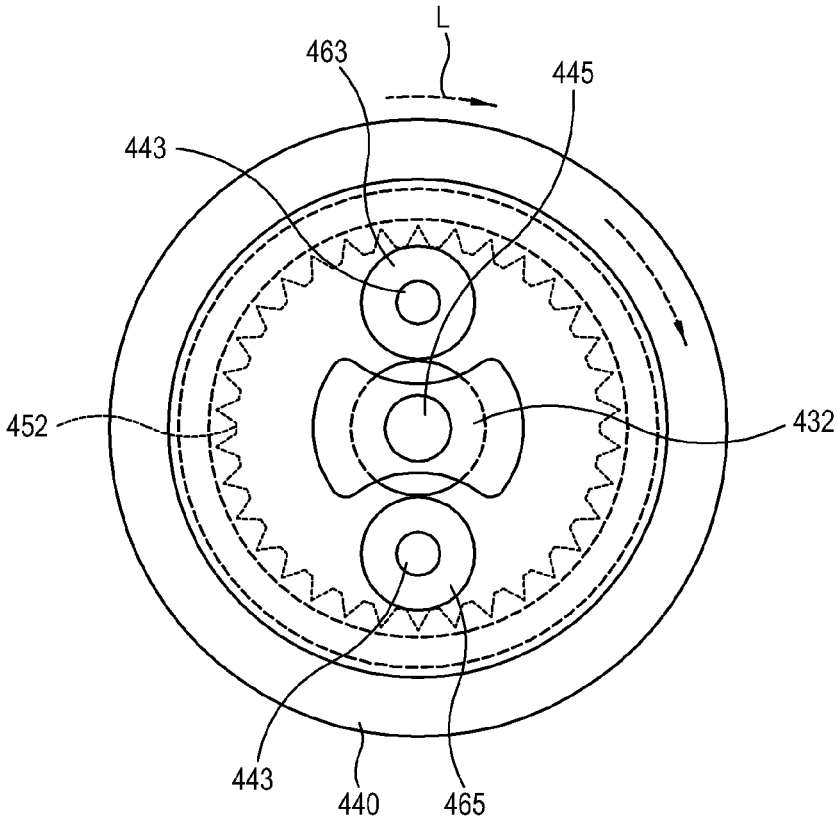
FIG. 19B illustrates the driving force transmitting process under a state in which the sun gear in FIG. 13 is prevented from rotating freely.

FIGS. 19A and 19B are schematic sectional views illustrating the state that the sun gear 430 and the ring gear 450 are inserted on the support gear 440. The ring gear 450 is illustrated by a dotted line.

As illustrated in FIG. 19A, the ring gear 450 receives a driving force from a gear 315 in FIG. 15. If a driving pinion 301 rotates in a forward direction, the ring gear 450 rotates in a clockwise direction L, as illustrated in FIG. 19A.

Here, if the sun gear 430 is under the state of being capable of freely rotating, that is, if the lever 420 is positioned in the second position, the planetary gears 463 and 465 engaged with an inner teeth 452 of the ring gear 450 turn about the stud 443 depending on the rotation of the ring gear 450.

As the planetary gears 463 and 465 turn, the protruding unit 432 of the sun gear 430 engaged to the planetary gears 463 and 465 rotates, and the sun 430 rotates together.

On the contrary, as illustrated in FIG. 19B, if the sun gear 430 is under the state of being prevented from freely rotating, that is, if the lever 420 is positioned in the first position, as the ring gear 450 rotates in the clockwise direction L, the planetary gears 463 and 465 do not rotate about its own axis, but revolve around the protruding unit 432 of the sun gear 430. Accordingly, the support gear 440 to which the planetary gears 463 and 465 are disposed also rotates in a clockwise direction L. Accordingly, the driving force of the ring gear 450 is transmitted to the support gear 440.

When printing is demanded and if it is necessary to drive the pickup unit 200 to pick up a printing medium, as illustrated in FIG. 16, the control unit 180*a* controls a solenoid 411 so that the driving force of the driving source 190 in FIG. 6 may be transmitted to the pickup unit 200.

In more detail, the control unit 180*a* controls the solenoid 411 to move the lever 420 to the first position so that the lever 420 may prevent the sun gear 430 from rotating. For this, the control unit 180*a* controls the electric power supplying unit 160*a* to supply an electric power to the solenoid 411. Accordingly, if the electric power is supplied, the solenoid 411 pulls an end part of the lever 420 in a direction J to engage the protrusion 423 of the lever 420 to the lever contact teeth 433 of the sun gear 430, thereby preventing the sun gear 430 from freely rotating.

If the sun gear 430 is prevented from freely rotating as described above, the support gear 440 rotates in the same direction as the rotation direction of the ring gear 450. Accordingly, the driving force of the driving source 190 in FIG. 6 may be transmitted to the pickup unit 200, and the pickup unit 200 may rotate in a direction (D) toward the plate 151 to pick up the printing medium.

Figure 17:
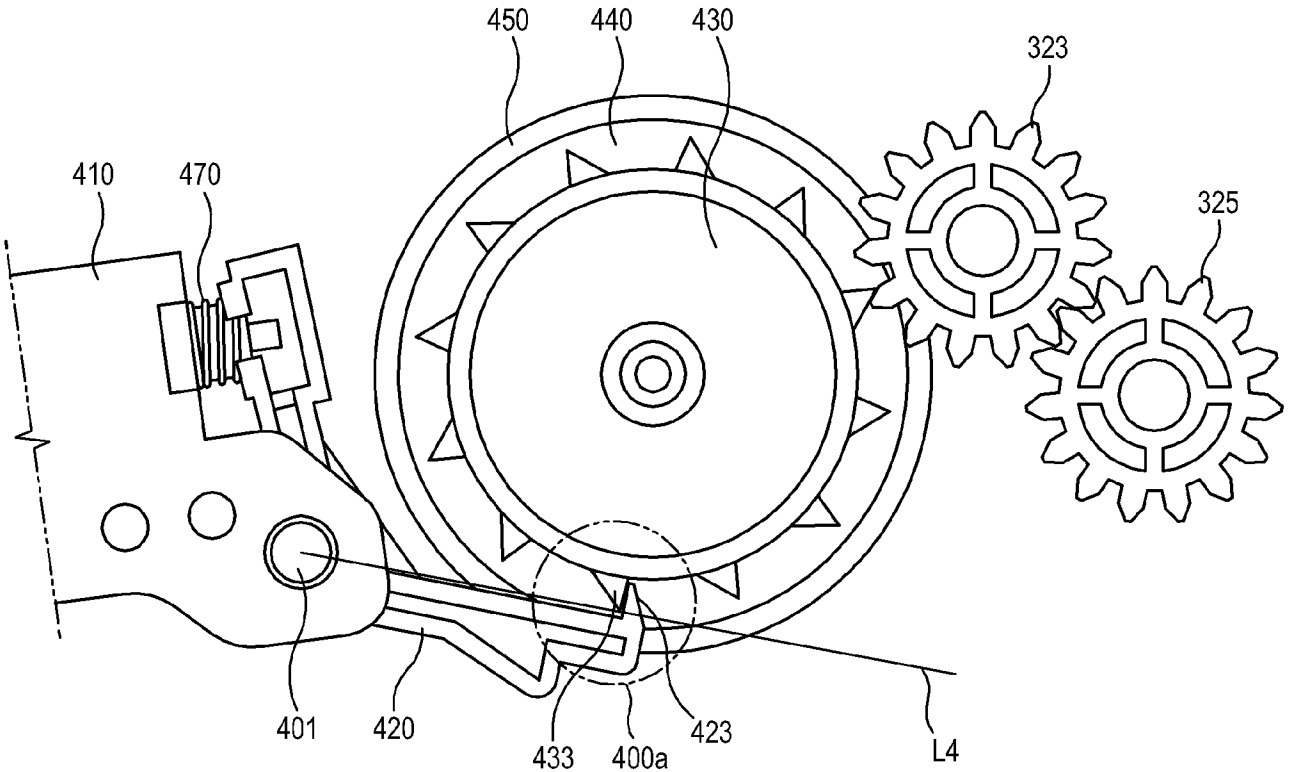
FIG. 17 is an enlarged side view of the image forming apparatus of FIG. 13.
Figure 17A:
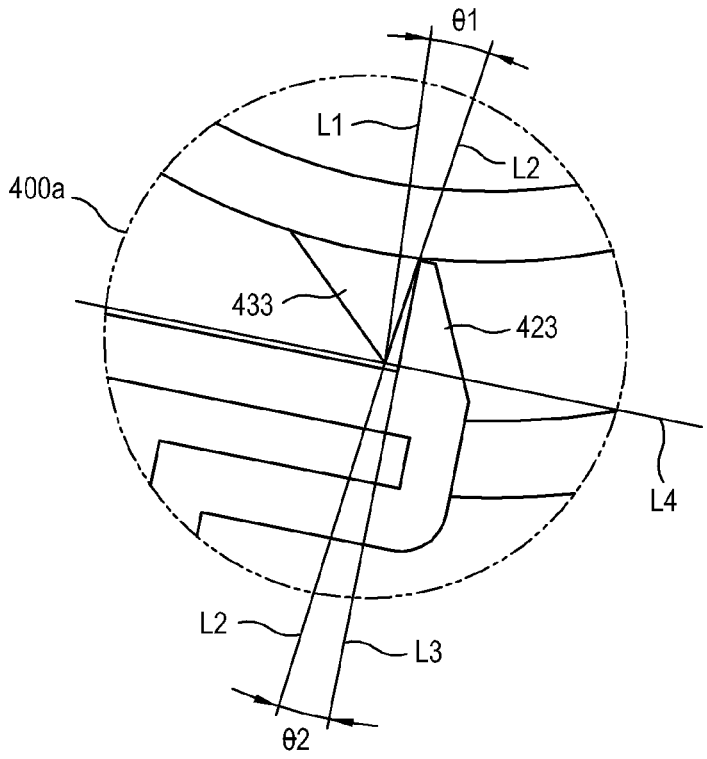
FIG. 17*a* is an enlarged side view of detail 400A of FIG. 17.

Referring now to FIG. 17, the following condition may be satisfied for a smooth driving regulation between the protrusion 423 of the lever 420 and the lever contact teeth 433 of the sun gear 430.

Condition $$\theta 2 \leq \theta 1$$

Here, a horizontal line L4 connecting a central point of the hinge pivot 401 of the lever 420 with an end part of the lever contact teeth 433, and a perpendicular line L1 connecting a rotation center of the sun gear 430 with the end part of the lever contact teeth 433 cross at right angles.

Here, θ1 is an angle between the perpendicular line L1 and a first extending line L2 of a contact surface contacting with the protrusion 423 in the lever contact teeth 433. In exemplary embodiments, the value of θ1 may be from about 0 degree to about 45 degrees.

Here, θ2 is an angle between the first extending line L2 and a second extending line L3 of a contact surface contacting with the lever contact teeth 433 in the protrusion 423.

As described above, in exemplary embodiments, an image forming apparatus according to the present general inventive concept has the following utilities.

A driving noise in a manual printing medium supplying may be eliminated or substantially reduced.

All of the processes of manual printing medium supplying, printing, and discharging may use a single driving motor to thereby reduce costs associated therewith.

A user may easily load a printing medium in the manual printing medium supplying, thereby improving a user convenience.

A regulating apparatus regulating a driving force in the manual printing medium supplying employs a relatively small size, thereby making a final product with a reduced overall size.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus which comprises a main body, the image forming apparatus comprising:

an image forming unit to form an image on a printing medium;

a plate disposed in a multi purpose tray to open and close a first side of the main body and to load the printing medium in an opening;

a pickup unit which comprises a driven gear to rotate in forward and backward directions, a pickup roller to receive a driving force from the driven gear to pick up a printing medium disposed on the plate, and a support frame to rotatably support the pickup roller and to interlock with the forward and backward rotations of the driven gear to move toward and away from the plate;

a driving source to drive the image forming unit and the driven gear; and a blocking gear disposed between the driven gear and the driving source to prevent the support frame spaced apart from the plate from moving toward the plate.

2. The image forming apparatus according to claim 1, further comprising:

a sensor which senses whether there is the printing medium on the plate or not; and a control unit which controls the driving source to rotate the driven gear in a forward direction so that the support frame can approach the plate and the pickup roller can pick up the printing medium depending on a printing demand if there is the printing medium.

3. The image forming apparatus according to claim 2, further comprising a pickup clutch which is disposed between the blocking gear and the driving source, and intermittently transmits a driving force of the driving source to the driven gear.

4. The image forming apparatus according to claim 3, wherein the control unit controls the pickup clutch so that the driving force of the driving source can be prevented from being transmitted to the driven gear if the printing medium on the plate is completely picked up.

5. The image forming apparatus according to claim 2, wherein the control unit controls the driving source to rotate the driven gear in a backward direction so that the support frame can be distanced from the plate if there is no printing medium on the plate.

6. The image forming apparatus according to claim 1, wherein the driving source comprises a single driving motor.

7. The image forming apparatus according to claim 1, wherein the image forming unit comprises:

a developing cartridge which is detachably mounted to the main body and includes a developer, the developing cartridge comprising:

an image carrying body on which an electrostatic latent image is formed; and a developing roller having the developer disposed thereon to develop the image on the image carrying body;

a transferring unit which is disposed to face the image carrying body, and transfers the developed image to the printing medium; and a fusing unit which fuses the developed image that is transferred onto the printing medium.

8. The image forming apparatus according to claim 7, further comprising:

a developing unit clutch which selectively transmits a driving force of the driving source to the developing cartridge driving gear and the transferring unit so that the developing cartridge driving gear and the transferring unit can rotate in one direction; and a fusing unit clutch which selectively transmits a driving force of the driving source to the fusing unit so that the fusing unit can rotate in one direction.

9. The image forming apparatus according to claim 1, further comprising:

an engagement unit which is provided to one of the support frame and the main body of the image forming apparatus; and an engagement threshold which is provided to the other of the support frame and the main body to be engaged with the engagement unit when the pickup unit moves to be spaced apart from the plate.

10. The image forming apparatus according to claim 9, wherein the engagement threshold rotates between a first position engaged with the engagement unit, and a second position released from the engagement unit, and the image forming apparatus further comprises an elastic member which elastically biases the engagement threshold toward the first position.

11. The image forming apparatus according to claim 10, wherein the engagement unit comprises an inclined surface which rotates the engagement threshold to the second position when contacting the engagement threshold.

12. The image forming apparatus according to claim 10, further comprising a control unit which controls the driving source to rotate the driven gear in the forward direction so that the engagement unit can be released from the engagement threshold depending on a printing demand if the printing medium exists on the plate.

13. The image forming apparatus according to claim 12, wherein a rotation moment by an elastic force of the elastic member is larger than a rotation moment by a weight of the pickup unit, and is less than a rotation moment generated by the forward direction of the driven gear.

14. The image forming apparatus according to claim 7, further comprising a cover which opens and closes a side of the main body, wherein the pickup unit is disposed on the cover to rotate together with the cover.

15. The image forming apparatus according to claim 14, wherein the plate is rotatably disposed to the cover.

16. The image forming apparatus according to claim 1, further comprising a pickup unit driving force regulating unit which is disposed between the blocking gear and the driving source, and intermittently transmits a driving force of the driving source to the pickup unit.

17. The image forming apparatus according to claim 16, wherein the pickup unit driving force regulating unit comprises:

a ring gear which receives the driving force of the driving source to rotate in forward and backward directions;

a sun gear which is disposed to face the ring gear; and a support gear which is interposed between the ring gear and the sun gear, comprises a ring gear boss extending in a first side along a rotation central axis of the support gear to support the ring gear and a sun gear boss extending in a second side along the rotation central axis to support the sun gear, and transmits the driving force to the driven gear of the pickup unit.

18. The image forming apparatus according to claim 17, further comprising a pair of planetary gears which are disposed to be spaced apart from each other inside the support gear, wherein the sun gear comprises a protruding unit inserted to the sun gear boss, and an outer surface of the protruding unit is formed with a sun gear teeth engaged with the planetary gears when being inserted to the sun gear boss.

19. The image forming apparatus according to claim 18, wherein the ring gear further comprises an inner teeth formed to an inner surface of the ring gear to be engaged with the planetary gears when being inserted to the ring gear boss.

20. The image forming apparatus according to claim 18, further comprising:

a lever movable to allow and to prevent a free rotation of the sun gear; and a lever driving unit to drive the lever.

21. The image forming apparatus according to claim 20, further comprising a control unit to control the lever driving unit so that the lever can prevent the free rotation of the sun gear if there is a printing demand.

22. The image forming apparatus according to claim 20, further comprising a control unit which controls the lever driving unit so that the lever can allow the free rotation of the sun gear if it is unnecessary to pick up the printing medium.

* * * * *